US010943522B1

(12) United States Patent
Iwase et al.

(10) Patent No.: US 10,943,522 B1
(45) Date of Patent: Mar. 9, 2021

(54) DEVICE AND METHOD FOR GATE DRIVING OF DISPLAY PANEL

(71) Applicant: SYNAPTICS INCORPORATED, San Jose, CA (US)

(72) Inventors: Takahide Iwase, Tokyo (JP); Hirotaka Osawa, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/669,850

(22) Filed: Oct. 31, 2019

(51) Int. Cl.
*G09G 3/20* (2006.01)

(52) U.S. Cl.
CPC ... *G09G 3/2003* (2013.01); *G09G 2310/0213* (2013.01); *G09G 2310/0243* (2013.01); *G09G 2310/0267* (2013.01); *G09G 2310/0275* (2013.01)

(58) Field of Classification Search
CPC combination set(s) only.
See application file for complete search history.

(56) References Cited

U.S. PATENT DOCUMENTS

2007/0057883 A1* 3/2007 Cho ..... G09G 3/3648 345/88
2008/0204391 A1* 8/2008 Yi ..... G09G 3/2003 345/88
2008/0266225 A1* 10/2008 Kim ..... G09G 3/3648 345/88
2015/0194110 A1* 7/2015 Park ..... G09G 3/3614 345/213
2020/0118476 A1* 4/2020 Kim ..... G09G 3/2003

* cited by examiner

*Primary Examiner* — Robin J Mishler
(74) *Attorney, Agent, or Firm* — Ferguson Braswell Fraser Kubasta P.C.

(57) ABSTRACT

A display device comprises a display panel and a display driver. The display panel comprises a plurality of gate lines. The display driver is configured to control, based on a first image data, an order in which the plurality of gate lines are driven.

20 Claims, 18 Drawing Sheets

DEVICE AND METHOD FOR GATE DRIVING OF DISPLAY PANEL

BACKGROUND

Field

Embodiments disclosed herein relate to a device and method for driving gates.

Description of the Related Art

Driving source lines of a display panel consumes electric power. A display device that comprises a display panel may be designed to reduce power consumption.

SUMMARY

In one or more embodiments, a display device comprises a display panel and a display driver. The display panel comprises a plurality of gate lines. The display driver controls, based on first image data, an order in which the plurality of gate lines are driven.

In one or more embodiments, a method comprises receiving first image data and controlling, based on first image data, an order in which a plurality of gate lines of a display panel are driven.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

Same or similar components may be denoted by same reference numerals in the attached drawings. Suffixes may be attached to reference numerals to distinguish same components from each other.

DETAILED DESCRIPTION

Figure 1:
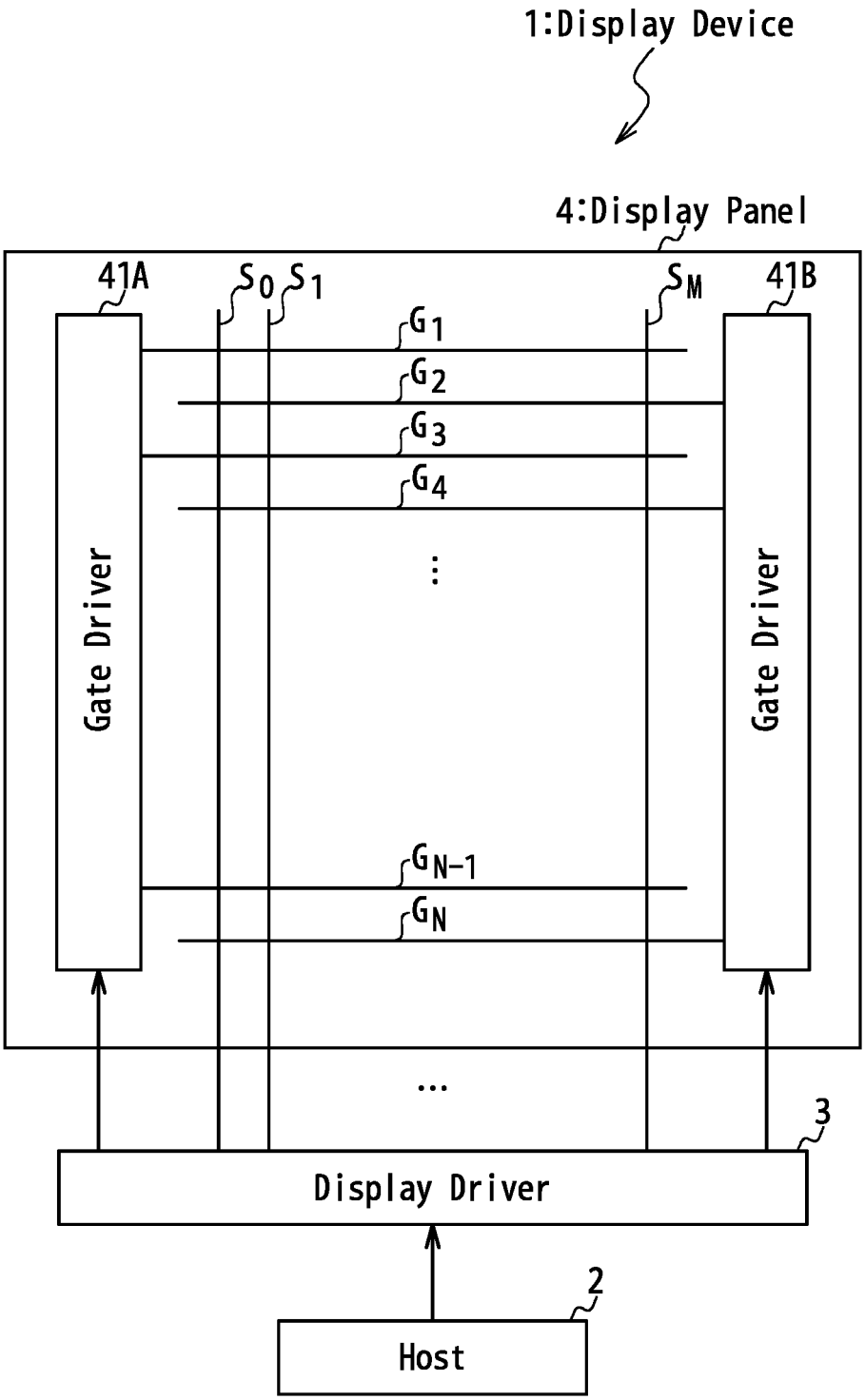
FIG. 1 illustrates an example configuration of a display device, according to one or more embodiments.

In one or more embodiments, as illustrated in FIG. 1, a display device 1 comprises a display driver 3 and a display panel 4. The display device 1 may further comprise a host 2. Alternatively, the display driver 3 may be connected to an external host 2.

The display driver 3 may be connected to the display panel 4. The display panel 4 may comprise a first gate driver 41A, a second gate driver 41B, gate lines $G_1$ to $G_N$, source lines $S_0$ to $S_M$, and not-illustrated pixels.

Each pixel may comprise a plurality of subpixels of different colors. Each pixel may comprise a first subpixel of a first color, a second subpixel of a second color, and a third subpixel of a third color. In one example, the first, second, and third colors may be red, green, and blue, respectively. Each pixel may further comprise at least one additional subpixel which displays a color other than, red, green, and blue. The combination of the colors of the subpixels of each pixel is not limited to that disclosed herein. The display panel 4 may be configured to be adapted to subpixel rendering (SPR). In this case, each pixel may comprise a plurality of first subpixels, a plurality of second pixels and/or a plurality of third pixels.

The display driver 3 may be connected to the first gate driver 41A, the second gate driver 41B, and the source lines S. The first gate driver 41A may be connected to one end of each of at least some of the gate lines G. The second gate driver 41B may be connected to one end of each of different at least some of the gate lines G.

The plurality of gate lines G may be each extended in a first direction. The plurality of source lines S may be each extended in a second direction different from the first direction. The first direction and the second direction may be orthogonal.

A subpixel may be disposed at an intersection of a gate line G and a source line S. To be more precise, the position of the subpixel may be apart from the intersection of the gate line G and the source line S by a certain distance in a certain direction.

The gate lines G connected to the first gate driver 41A may be referred to as first group of gate lines G. The gate lines G connected to the second gate driver 41B may be referred to as second group of gate lines G. The first group of gate lines G and the second group of gate lines G may be arrayed in a one-by-one alternating manner in the second direction.

Figure 2:
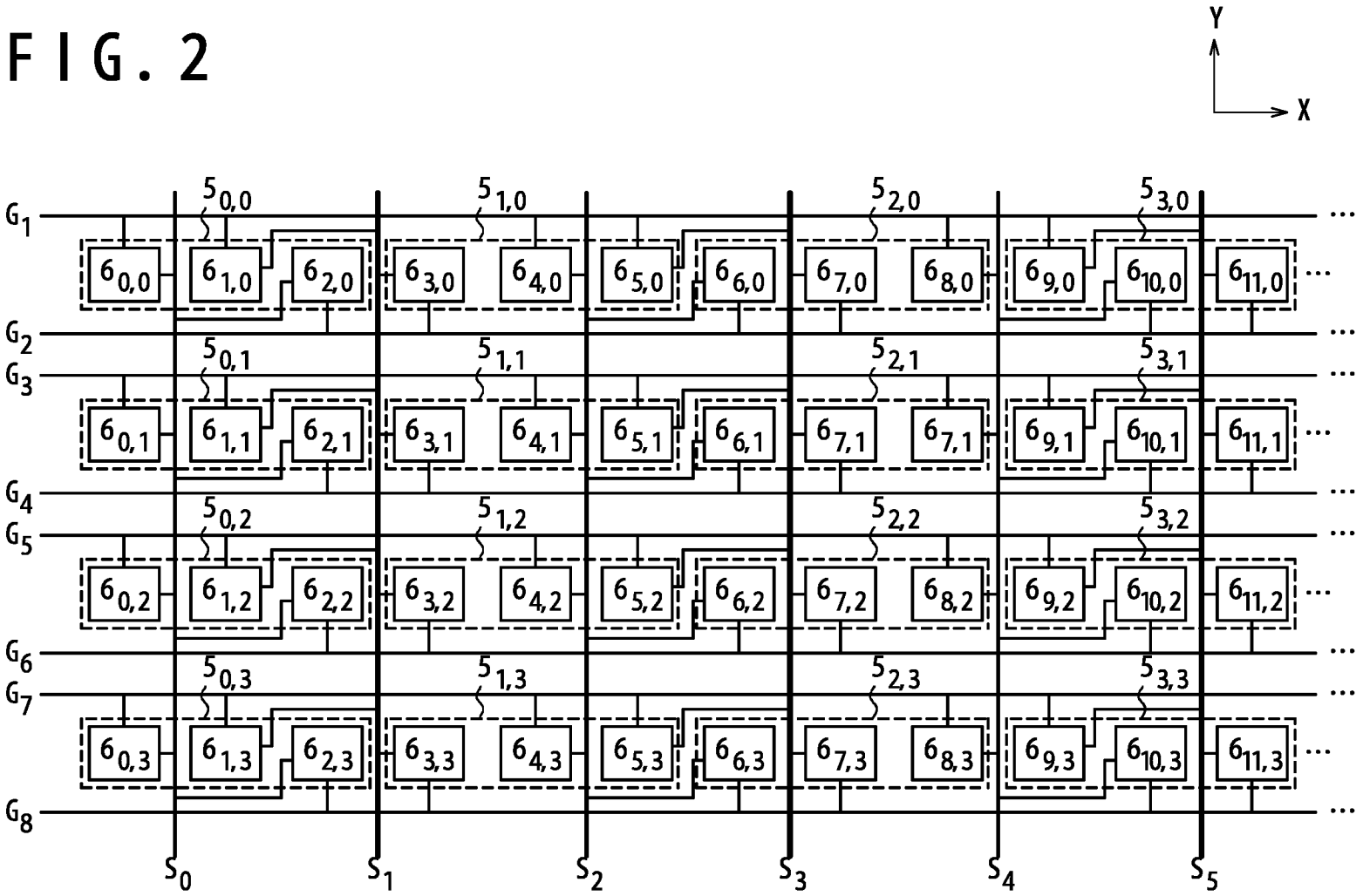
FIG. 2 illustrates an example configuration of a display panel, according to one or more embodiments.

In one or more embodiments, as illustrated in FIG. 2, the display panel 4 comprises source lines S, gate lines G, pixels $\mathbf{5}_{a,\ b}$, and subpixels $\mathbf{6}_{i,\ j}$. A pixel $\mathbf{5}_{a,\ b}$ may comprise a subpixel $\mathbf{6}_{3a,\ b}$ of the first color, a subpixel $\mathbf{6}_{3a+1,\ b}$ of the second color, and a pixel $\mathbf{6}_{3a+2,\ b}$ of the third color. For example, the pixel $\mathbf{5}_{0,\ 0}$ comprises a subpixel $\mathbf{6}_{0,\ 0}$ of the first color, a subpixel $\mathbf{6}_{1,\ 0}$ of the second color, and a pixel $\mathbf{6}_{2,\ 0}$ of the third color.

In the example illustrated in FIG. 2, the subpixels $\mathbf{6}_{3a,\ b}$, $\mathbf{6}_{3a+1,\ b}$, and $\mathbf{6}_{3a+2,\ b}$ of the pixel $\mathbf{5}_{a,\ b}$ may be arrayed in the Y direction. In the example illustrated in FIG. 2, in each pixel $\mathbf{5}_{a,\ b}$, the subpixel $\mathbf{6}_{3a+1,\ b}$ of the second color is adjacent to the $\mathbf{6}_{3a,\ b}$ of the first color in the +Y direction, and the subpixel $\mathbf{6}_{3a+2,\ b}$ of the third color is adjacent to the $\mathbf{6}_{3a+1,\ b}$ of the second color in the +Y direction. It should be noted however that the above-described arrangement is merely one example, not limiting this embodiment.

In one or more embodiments, the display panel 4 is configured as a dual-gate panel. In such embodiments, a plurality of subpixels $\mathbf{6}_{i,j}$ arrayed in a direction parallel to the direction in which a gate line $G_v$ is extended, the Y axis direction in the example illustrated in FIG. 2, may be connected to a pair of adjacent gate lines $G_v$ and $G_{v+1}$. In the example illustrated in FIG. 2, gate lines $G_1$ and $G_2$ may constitute a first gate line pair, gate lines $G_3$ and $G_4$ may constitute a second gate line pair, gate lines $G_5$ and $G_6$ may constitute a third gate line pair, and gate lines $G_7$ and $G_8$ may constitute a fourth gate line pair.

One of each pair of adjacent gate lines $G_v$ and $G_{v+1}$ may be connected to the first gate driver 41A and the other may be connected to the second gate driver 41B. For example, the gate lines $G_1$, $G_3$, $G_5$, and $G_7$, denoted by odd suffixes v, may be connected to the first gate driver 41A, and the gate lines $G_2$, $G_4$, $G_6$, and $G_8$, denoted by even suffixes v, may be connected to the second gate driver 41B. Further, one or more of the subpixels $\mathbf{6}_{3a,\,b}$, $\mathbf{6}_{3a+1,\,b}$, and $\mathbf{6}_{3a+2,\,b}$ included in the same pixel $\mathbf{5}_{a,\,b}$ may be connected to one of the pair of the gate lines $G_v$ and $G_{v+1}$, and different one or more of the same may be connected to the other of the pair of the gate lines $G_v$ and $G_{v+1}$. As for the subpixels $\mathbf{6}_{0,\,0}$, $\mathbf{6}_{1,\,0}$, and $\mathbf{6}_{2,\,0}$ of the pixel $\mathbf{5}_{0,\,0}$, for example, the subpixels $\mathbf{6}_{0,\,0}$ and $\mathbf{6}_{1,\,0}$ may be connected to the gate line $G_1$, and the subpixel $\mathbf{6}_{2,\,0}$ may be connected to the gate line $G_2$.

In embodiments in which the display panel 4 is configured as a dual-gate panel as illustrated in FIG. 2, subpixels 6 of two colors may be alternatingly arrayed along a source line $S_u$. Two subpixels 6 connected to the same source line S may be different colors and connected to different gate lines $G_v$. In one or more embodiments, the number of colors of subpixels 6 connected to the same source line $S_u$ may be two.

In one or more embodiments, a first group of subpixels $\mathbf{6}_{i,\,j}$ arrayed in the same direction as the direction in which the source lines S are extended (the X axis direction in FIG. 2) are connected to the same source line $S_u$. A second group of subpixels $\mathbf{6}_{i+2,\,j}$ different from the first group of subpixels $\mathbf{6}_{i,\,j}$ are also connected to the same source line $S_u$. Here, a third group of subpixels $\mathbf{6}_{i+1,\,j}$ disposed between the first group and the second group are connected to a different source line $S_{u+1}$ or $S_{u-1}$ adjacent to the source line $S_u$.

The two groups of subpixels $\mathbf{6}_{i,\,j}$ and $\mathbf{6}_{i+2,\,j}$ may be connected to the same source line $S_u$, and each group of subpixels 6 may comprise a plurality of subpixels 6 arrayed in the same direction as the direction in which the source line $S_u$ is extended. In the example illustrated in FIG. 2, for any suffix j, the subpixels $\mathbf{6}_{0,\,j}$ and $\mathbf{6}_{2,\,j}$ are connected to the source line $S_0$, and the subpixels $\mathbf{6}_{1,\,j}$ and $\mathbf{6}_{3,\,j}$ are connected to the source line $S_1$. Similarly, the subpixels $\mathbf{6}_{4,\,j}$ and $\mathbf{6}_{6,\,j}$ are connected to the source line $S_2$, and the subpixels $\mathbf{6}_{5,\,j}$ and $\mathbf{6}_{7,\,j}$ are connected to the source line $S_3$.

The pair of the adjacent source lines $S_u$ and $S_{u+1}$ may be connected to four groups of subpixels $\mathbf{6}_{i,\,j}$, $\mathbf{6}_{i+1,\,j}$, $\mathbf{6}_{i+2,\,j}$, and $\mathbf{6}_{i+3,\,j}$, denoted by four successive suffixes i. The next pair of adjacent source lines $S_{u+2}$ and $S_{u+3}$, which are adjacent to this pair of the adjacent source lines $S_u$ and $S_{u+1}$, may be connected to four groups of subpixels $\mathbf{6}_{i+4,\,j}$, $\mathbf{6}_{i+5,\,j}$, $\mathbf{6}_{i+6,\,j}$, and $\mathbf{6}_{i+7,\,j}$, denoted by following four successive suffixes i. The above-described connections related to the source lines $S_u$ are merely one example, not limiting this embodiment.

Figure 3:
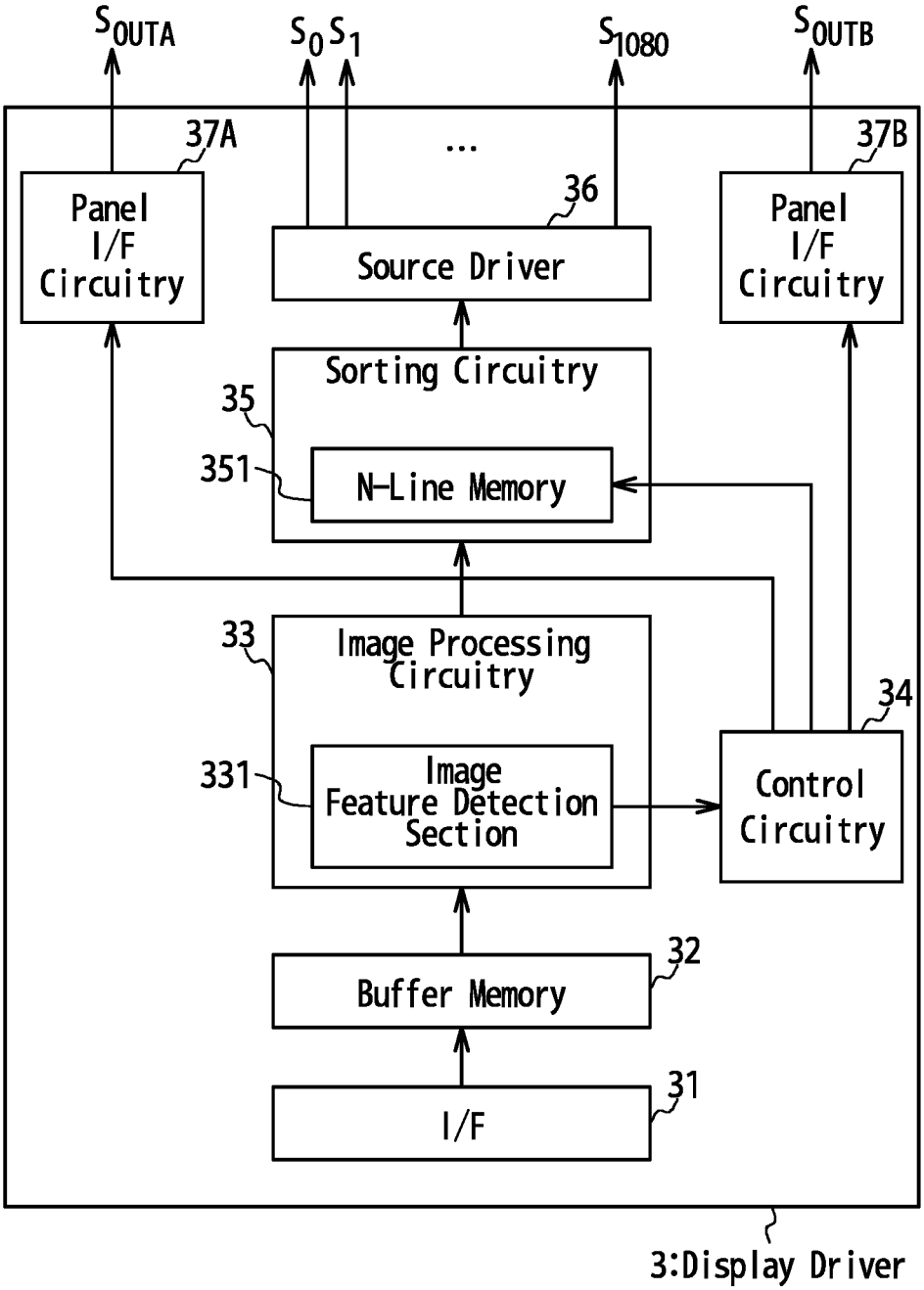
FIG. 3 illustrates an example configuration of a display driver, according to one or more embodiments.

FIG. 3 is one example configuration of the display driver 3, according to some embodiments.

In one or more embodiments, as illustrated in FIG. 3, the display driver 3 comprises interface circuitry 31, a buffer memory 32, image processing circuitry 33, control circuitry 34, sorting circuitry 35, a source driver 36, first panel interface circuitry 37A, and second panel interface circuitry 37B. In some cases, the buffer memory 32 may be omitted. The image processing circuitry 33 may comprise an image feature detection section 331. The sorting circuitry 35 comprises an N-line memory 351.

The interface circuitry 31 may be configured to forward the image data received from the host 2 to the buffer memory 32. In one embodiment, the image data comprises pixel data associated with respective pixels 5, and the pixel data comprise subpixel data associated with respective subpixels 6 contained in the corresponding pixel 5. Subpixel data may comprise a grayscale value of a corresponding subpixel $\mathbf{6}_{i,\,j}$, and the level of a drive voltage supplied to the subpixel $\mathbf{6}_{i,\,j}$ is set based on the grayscale value. The buffer memory 32 may be configured to temporarily store therein the image data received from the interface circuitry 31.

In one or more embodiments, the image processing circuitry 33 is configured to perform desired image processing on the image data read out from the buffer memory 32 and supply image data acquired through this image processing to the sorting circuitry 35. The image processing circuitry 33 may receive the image data directly from the interface circuitry 31 in embodiments in which the buffer memory 32 is not disposed.

The control circuitry 34 may be configured to control operations of the sorting circuitry 35, the first panel interface circuitry 37A, and the second panel interface circuitry 37B.

The sorting circuitry 35 is configured to sort the image data received from the image processing circuitry 33 under control of the control circuitry 34. The sorting circuitry 35 may use the N-line memory 351 as a work area for the sorting.

The source driver 36 may be configured to drive the source lines S of the display panel 4 based on the image data received from the sorting circuitry 35.

In one or more embodiments, the first panel interface circuitry 37A is configured to generate first gate control signals $S_{OUTA}$ to control the gate driver 41A of the display panel 4, and the second panel interface circuitry 37B is configured to generate second gate control signals $S_{OUTB}$ to control the gate driver 41B. The first gate control signals $S_{OUTA}$ and the second gate control signals $S_{OUTB}$ may be used to control the order in which the gate lines G are driven by the gate driver 41A and the gate driver 41B.

In one or more embodiments, the control circuitry 34 is configured to control, based on the image data received by the image processing circuitry 33, the order in which the gate lines G are driven. The image feature detection section 331 of the image processing circuitry 33 may be configured to detect a feature of the image data, and the control circuitry 34 may be configured to control, based on the detected feature, the order in which the gate lines G are driven. The control circuitry 34 may be configured to control, based on the detected feature, the generation of the first gate control signals $S_{OUTA}$ and the second gate control signals $S_{OUTB}$ by the first panel interface circuitry 37A and the second panel interface circuitry 37B. The first gate control signals $S_{OUTA}$ and the second gate control signals $S_{OUTB}$ may be generated to drive the gate lines G in a desired order based on the detected feature.

Figure 4:
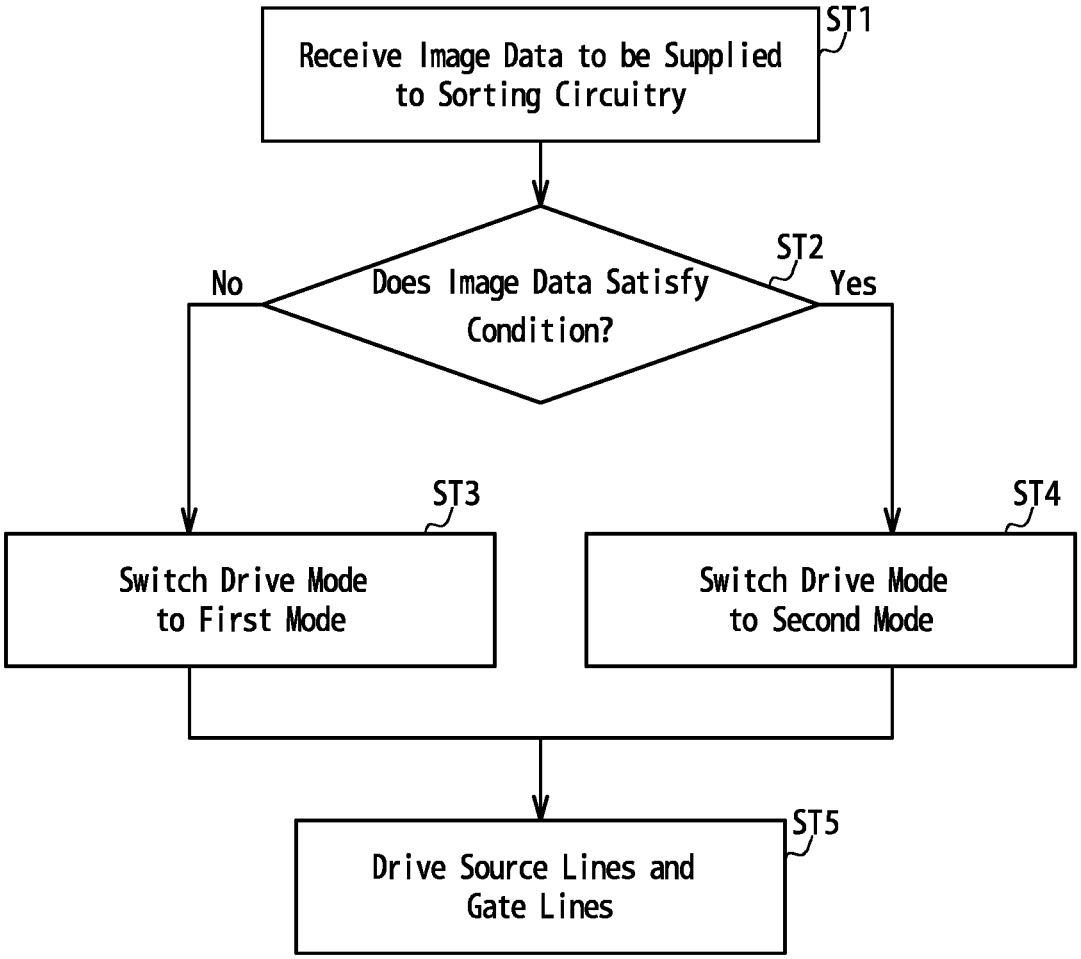
FIG. 4 illustrates an example method, according to one or more embodiments.

In one or more embodiments, as illustrated in FIG. 4, the image processing circuitry 33 receives image data from the buffer memory 32 in a first step ST1. The image processing circuitry 33 may receive the image data from the interface circuitry 31 when the buffer memory 32 is not disposed. The image processing circuitry 33 may generate an image data to be supplied to the sorting circuitry 35 by performing image processing on the received image data.

In a second step ST2, the image feature detection section 331 of the image processing circuitry 33 detects whether the image data received from the buffer memory 32 or the interface circuitry 31 satisfies a predetermined condition. In one example, the image feature detection section 331 may detect that an image data for one frame displayed on the display panel 4 specifies the same color for all the pixels 5. In another example, the image feature detection section 331 may detect that at least a portion of an image data for one frame displayed on the display panel 4 specifies the same color for pixels 5 associated with a predetermined number of successive horizontal lines. The same color may be any one of the colors of the subpixels 6. In one or more embodiments, when the image data does not satisfy the predetermined condition, a third step ST3 is executed. When the image data satisfies the predetermined condition, a fourth step ST4 is executed.

In the third step ST3, the control circuitry 34 switches the driving mode of the gate lines G to a first mode. In one or more embodiments, in the first mode, the plurality of gate lines G are driven in the same order as the order in which the gate lines G are arranged on the display panel 4. In the example illustrated in FIG. 1, the first, second, third, and fourth gate lines $G_1$, $G_2$, $G_3$, and $G_4$ may be driven in this order. In an alternative example, the first, second, third, and fourth gate lines $G_1$, $G_2$, $G_3$, and $G_4$ may be driven in the opposite order to this. The first mode as thus described may be also referred to as "Z scan mode." The control circuitry 34 may control the first panel interface circuitry 37A and the second panel interface circuitry 37B to cause the first gate driver 41A and the second gate driver 41B to drive the gate lines G in the first mode.

In the fourth step ST4, the control circuitry 34 switches the driving mode of the gate lines G to the second mode. In one or more embodiments, in the second mode, gate lines G connected to the second gate driver 41B of at least some of the plurality of gate lines $G_v$ may be driven after those connected to the second gate driver 41A of the at least some of the plurality of gate lines $G_v$. In the example illustrated in FIG. 1, the second and fourth gate lines $G_2$ and $G_4$ may be driven after the first and third gate lines $G_1$ and $G_3$ are driven. Gate lines other than the first to fourth gate lines $G_1$ to $G_4$, which are not illustrated in FIG. 1, may be driven in a similar manner in units of a predetermined number of gate lines. For example, for every four gate lines G, driving the first to fourth gate lines $G_1$ to $G_4$ may be followed by driving the sixth and eighth gate lines after the fifth and seventh gate lines are driven. The above-mentioned order is merely one example, not limiting this embodiment. In another example, the gate lines G connected to the first gate driver 41A may be driven after the gate lines G connected to the second gate driver 41B are driven. The second mode as thus described may be also referred to as "N-drive mode."

In one or more embodiments, the source lines S and the gate lines G are driven in a fifth step ST5. In the fifth step ST5, the sorting circuitry 35 may sort the image data received from the image processing circuitry 33 based on the driving mode and forward the sorted image data to the source driver 36. In one embodiment, the sorting circuitry 35 sorts the image data when the driving mode is the second mode and withholds the sorting when the driving mode is the first mode. In one or more embodiments, the source driver 36 may drive the source lines S based on the image data received from the sorting circuitry 35. In one or more embodiments, the first and second gate drivers 41A and 41B drive the gate lines G in the first or second mode in the meanwhile. This achieves displaying of an image corresponding to the image data on the display panel 4.

Figure 5A:
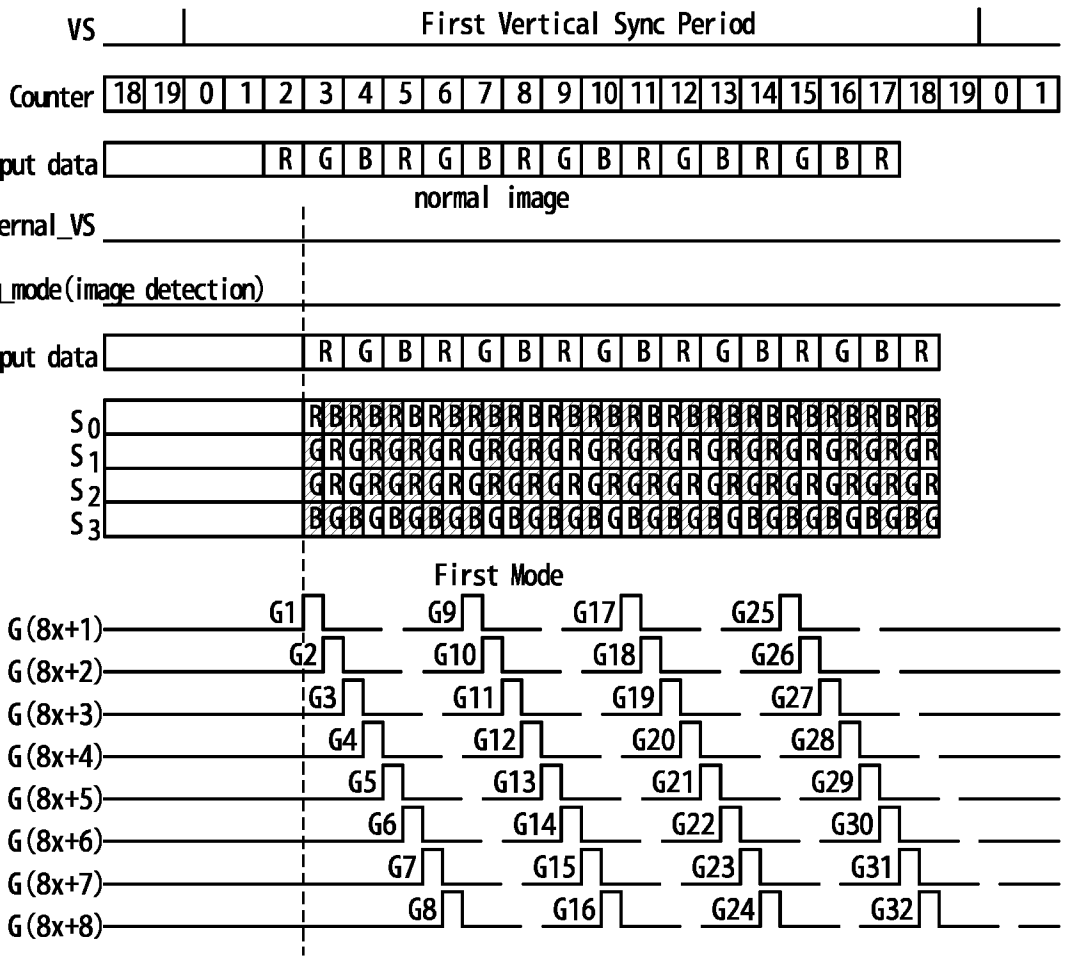
FIGS. 5A to 5C illustrate an example operation of a display device, according to one or more embodiments.
Figure 5B:
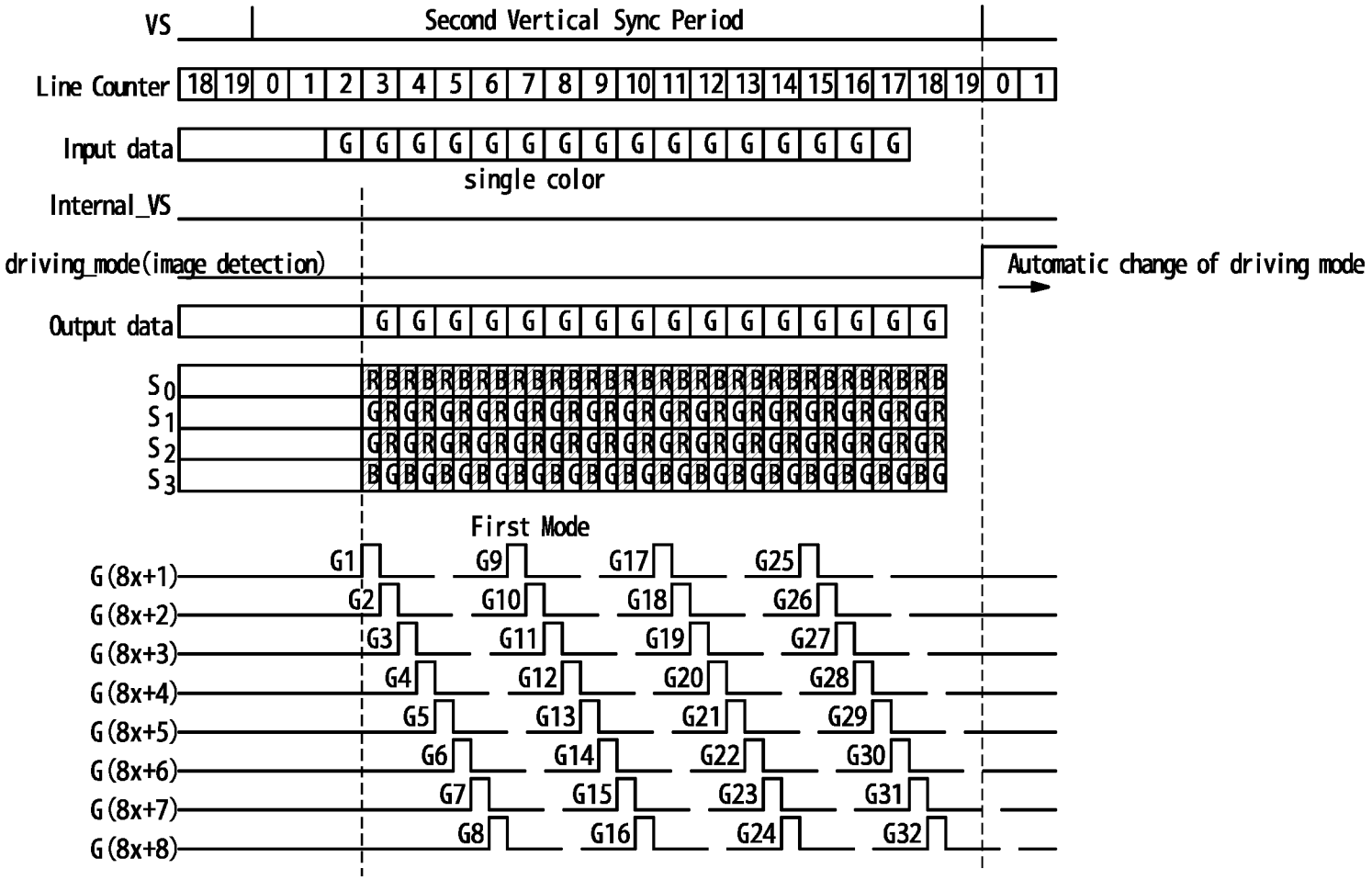
Figure 5C:
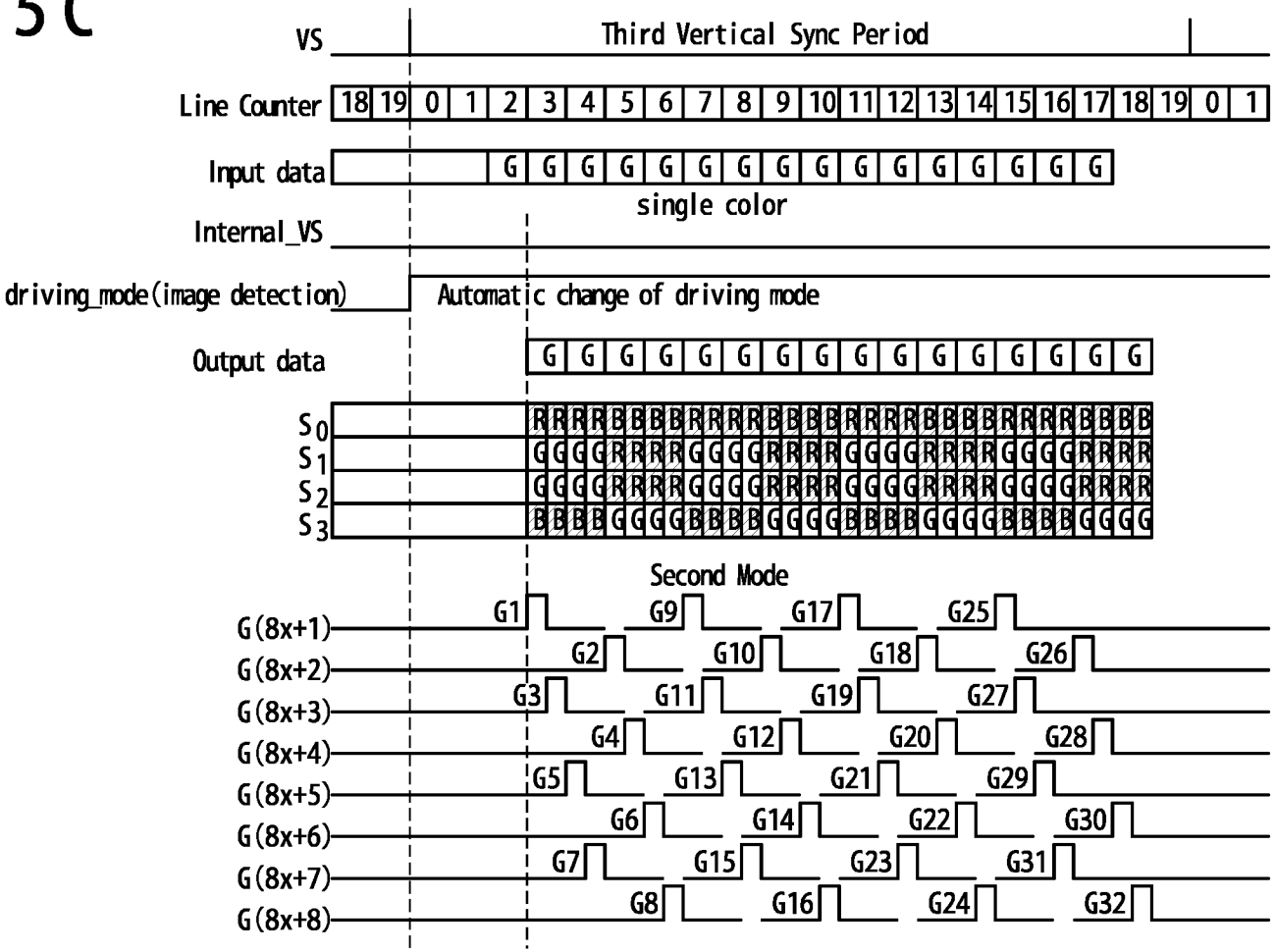

FIGS. 5A, 5B, and 5C are timing charts illustrating an example operation of the display device 1. In FIGS. 5A, 5B, and 5C, "VS" indicates supply of vertical sync packets from the host 2 to the display driver 3. "Line Counter" indicates the value of a line counter that counts horizontal sync periods. "Input data" indicates the image data inputted to the image processing circuitry 33. The initial letter of the color in each box indicates that all the pixels 5 in each horizontal line are the same color. "Internal_VS" indicates an internal vertical sync signal. The internal vertical sync signal may be a vertical sync signal used in the display driver 3, for example. "driving_mode" indicates the driving mode. "Output data" indicates the image data outputted to the sorting circuitry 35 from the image processing circuitry 33. "$S_0$" to "$S_3$" indicate the subpixel data corresponding to subpixels 6 connected to the source lines $S_0$ to $S_3$, respectively. "$G_{(8x+1)}$" to "$G_{(8x+8)}$" indicate gate signals for driving the respective gate lines G, where x is any integer. For example, the row "$G_{(8x+1)}$" illustrates a series of waveforms of the gate signals for driving the plurality of gate lines $G_1$, $G_9$, $G_{17}$, $G_{25}$ and so forth with two of the gate signals spaced apart from each other. This illustration is to make efficient use of the area of the figure; it should be noted that this illustration does not mean that a plurality of gate signals for driving the gate lines $G_{(8x+1)}$ for different integers x are applied to the same gate line G. In one or more embodiments, the operation illustrated in FIG. 5A is performed in a first vertical sync period, the operation illustrated in FIG. 5B is performed in a second vertical sync period that follows the first vertical sync period, and the operation illustrated in FIG. 5C is performed in a third vertical sync period that follows the second vertical sync period.

In the example operation illustrated in FIGS. 5A, 5B, and 5C, the display device 1 is configured to detect whether the image data received by the image processing circuitry 33 satisfies a predetermined condition. In one or more embodiments, the image data that satisfies the predetermined condition is an image data that specifies the same color for all the pixels 5 for one frame. The same color may be any one of the colors of the subpixels 6. The display device 1 may switch the driving mode of the gate lines G to the second mode when detecting the image data that satisfies the predetermined condition.

In the embodiment illustrated in FIGS. 5A, 5B, and 5C, the grayscale values of the respective subpixels 6 described in pixel data of the image data are the maximum grayscale value or the minimum grayscale value. In such embodiments, the drive voltages applied to the respective subpixels 6 each have a voltage level corresponding to the minimum grayscale value or a voltage level corresponding to the maximum grayscale value. A white box indicates a state in which the drive voltage of the level corresponding to the maximum grayscale value is applied to the source lines S, and a hatched box indicates a state in which the drive voltage of the level corresponding to the minimum grayscale value is applied to the source lines S. The letter "R", "G", and "B" in the boxes indicate the corresponding colors of the subpixels $\mathbf{6}_{i,j}$, that is, red for the first color, green for the second color, and blue for the third color with the initial letters thereof. These are merely one example, not limiting this embodiment.

In one or more embodiments, as illustrated in FIG. 5A, the driving mode is set to the first mode in the first vertical sync period, and the plurality of gate lines G are driven in the order in which the gate lines G are arrayed on the display panel 4. In the operation illustrated in FIG. 5A, an image data corresponding to a general image is inputted to the image processing circuitry 33. In one or more embodiments, the driving mode of the gate lines G is set to the first mode also in the following second vertical sync period.

In the following second vertical sync period, as illustrated in FIG. 5B, the image data input to the image processing circuitry 33 specifies green (the second color) for all the pixels 5 of the image. In one or more embodiments, all the subpixels 6 of the second color in the display panel 4 are set to the on state with the drive voltage corresponding to the maximum grayscale value, while all the subpixels of the subpixels 6 of the first and third colors are set to the off state. In the operation illustrated in FIG. 5B, the order of pixel data in the image data is not sorted. With respect to the source lines $S_1$, $S_2$, and $S_3$ connected to the subpixels 6 of the second color, subpixel data corresponding to the subpixels 6 of the second color (G), which are to be on, and subpixel data corresponding to the subpixels 6 of the first color (R) and the third color (B), which are to be off, are alternatively arranged. In such cases, the drive voltages applied to the source lines $S_1$, $S_2$, and $S_3$ are frequently pulled up from the minimum level to the maximum level and pulled down from the maximum level to the minimum level. Such operation may increase power consumption.

In one or more embodiments, the image feature detection section 331 of the image processing circuitry 33 detects an image data that specifies the second color for all the pixels 5 in the second vertical sync period. Based on this detection, the control circuitry 34 sets the driving mode of the gate lines G to the second mode in the following third vertical sync period. As illustrated in FIG. 5C, in the third vertical sync period, the gate lines $G_1$, $G_3$, $G_5$, and $G_7$ are driven in this order, and then the gate lines $G_2$, $G_4$, $G_6$, and $G_8$ are driven in this order in units of eight gate lines G, in one or more embodiments. In general, an operation of driving the gate lines $G_{(8x+1)}$, $G_{(8x+3)}$, $G_{(8x+5)}$, and $G_{(8x+7)}$ in this order and then driving the gate lines $G_{(8x+2)}$, $G_{(8x+4)}$, $G_{(8x+6)}$, and $G_{(8x+8)}$ in this order for any integer x may be repeated in units of eight gate lines G for the integer x being incremented.

In the third vertical sync period, as is the case with the second vertical sync period, the image data supplied to the sorting circuitry 35 specifies green (the second color) for all the pixels 5 of the image. In response to the driving mode being set to the second mode, the sorting circuitry 35 sorts the order of the pixel data in the image data and supplies the sorted image data to the source driver 36. In one or more embodiments, the order of the pixel data of the image data are sorted so that the subpixels 6 driven with the drive voltage corresponding to the maximum grayscale value are successively driven, and the subpixels 6 driven with the drive voltage corresponding to the minimum grayscale value are successively driven. This operation reduces the number of switching of the voltages applied to the source lines S between the level corresponding to the minimum grayscale value and the level corresponding to the maximum grayscale value, achieving reduction in the power consumption.

Figure 6A:
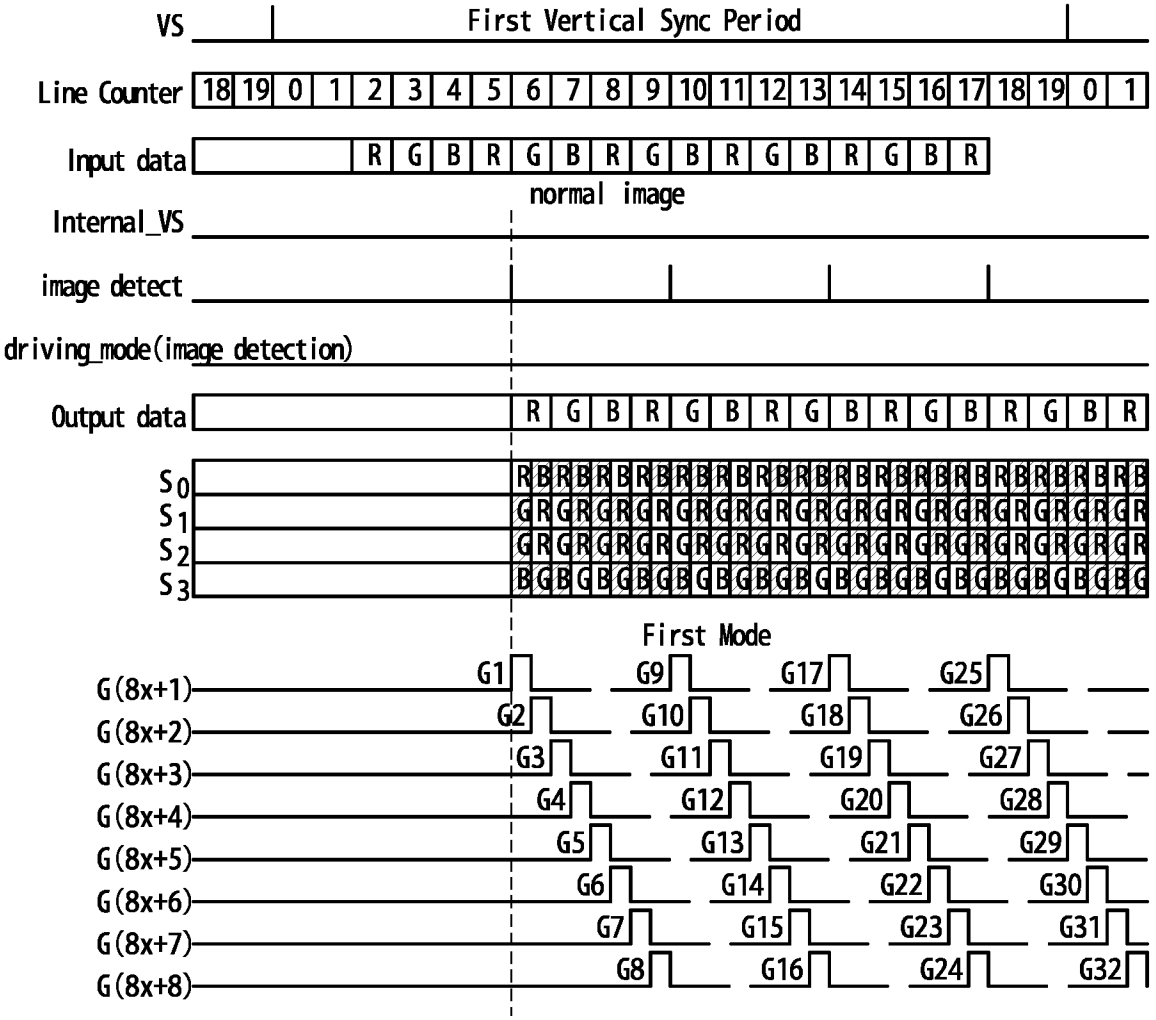
FIGS. 6A to 6C illustrate an example operation of a display device, according to one or more embodiments.
Figure 6B:
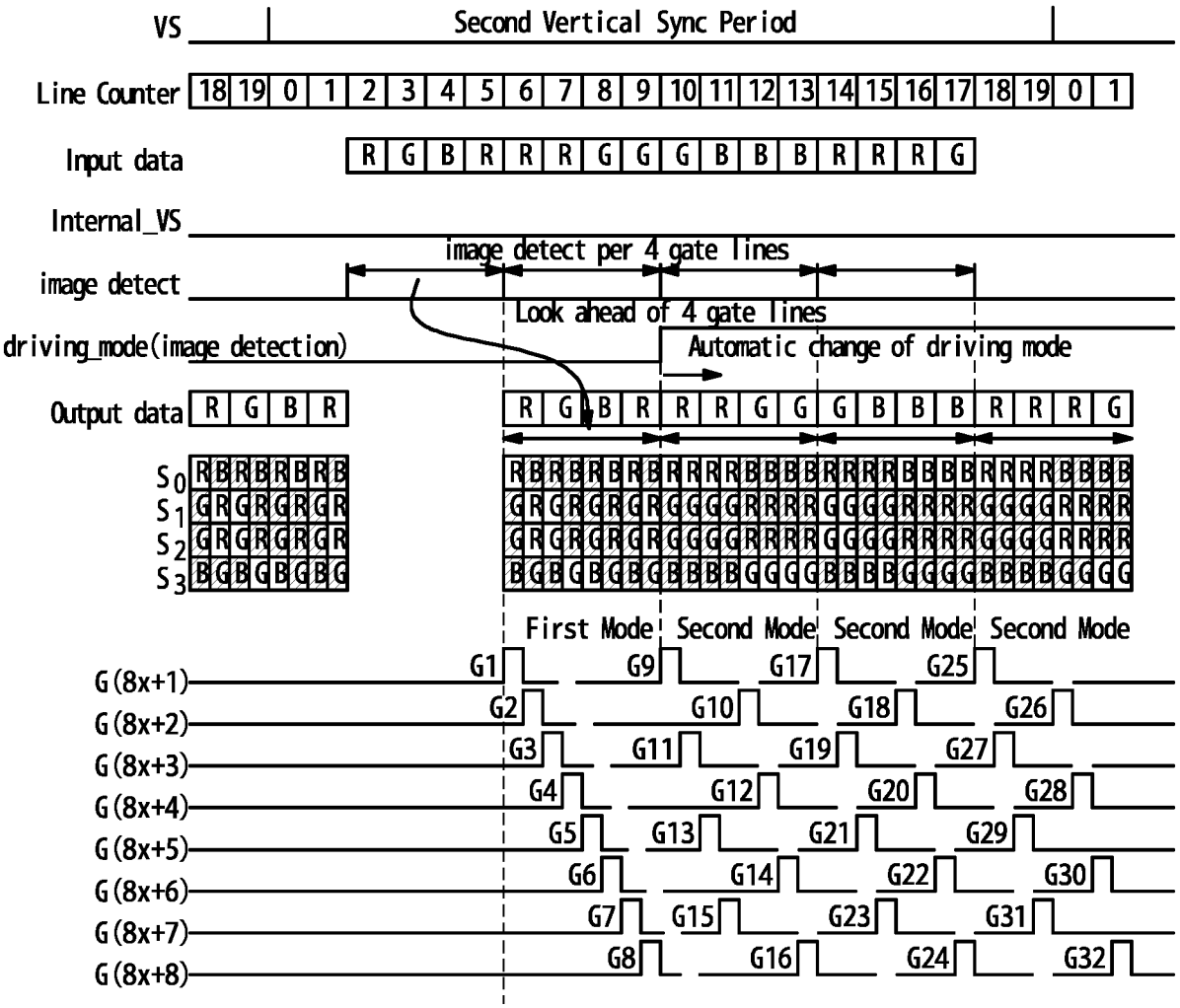
Figure 6C:
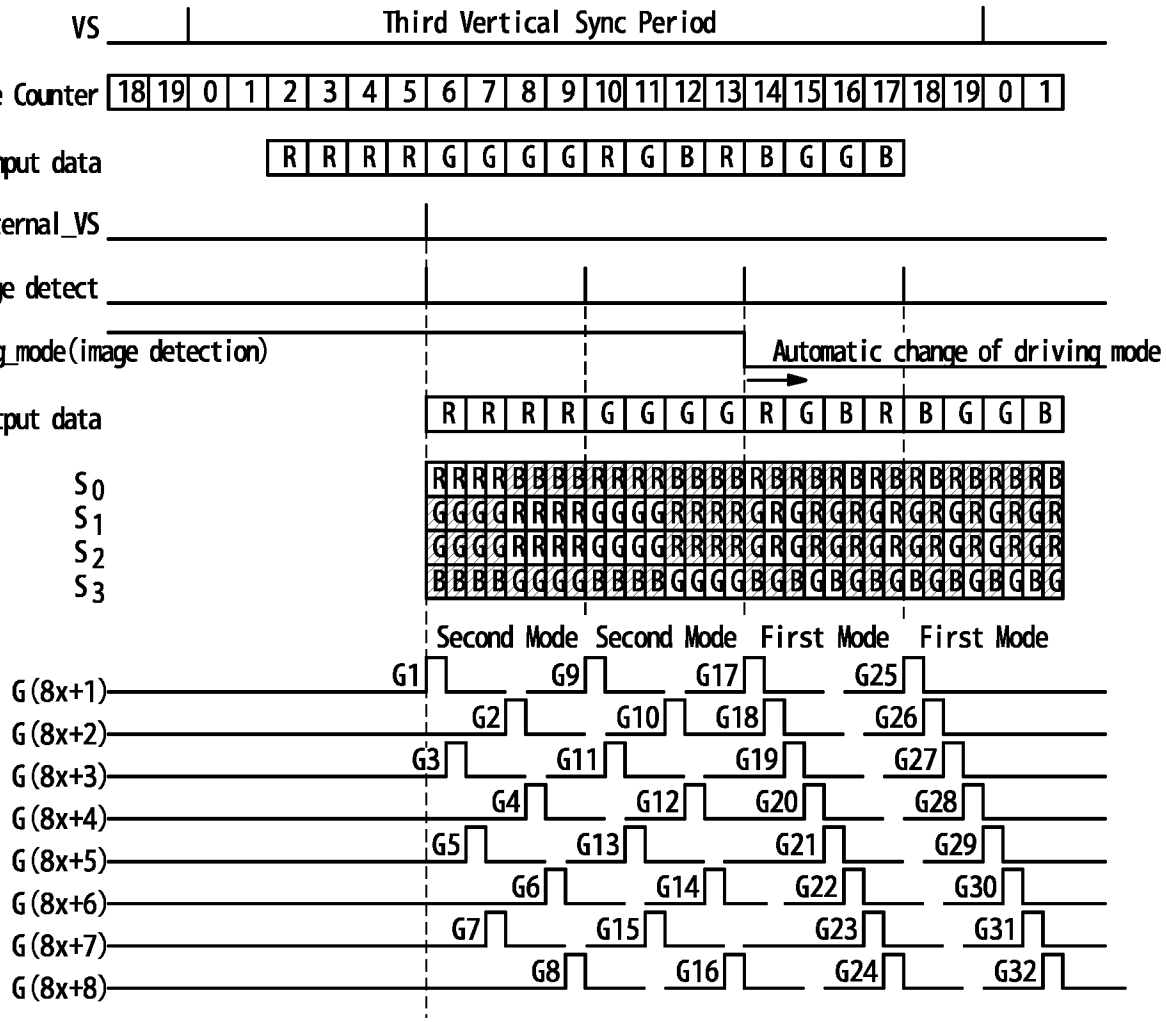

FIGS. 6A, 6B, and 6C are timing charts illustrating another example operation of the display device 1. In one or more embodiments, the operation illustrated in FIG. 6A is performed in a first vertical sync period, the operation illustrated in FIG. 6B is performed in a second vertical sync period that follows the first vertical sync period, and the operation illustrated in FIG. 6C is performed in a third vertical sync period that follows the second vertical sync period.

In embodiments as illustrated in FIGS. 6A, 6B, and 6C, the driving mode of the gate lines G is switched to the second mode when an image data that specifies the same color for pixels 5 of a predetermined number of successive horizontal lines is detected. The same color may be any one of the colors of the subpixels 6. For example, the driving mode of the gate lines G may be switched to the second mode when an image data that specifies the same color for pixels 5 of two successive horizontal lines is detected.

In one or more embodiments, as illustrated in FIG. 6A, the driving mode is set to the first mode in the first vertical sync period, and the plurality of gate lines G are driven in the order in which the gate lines G are arrayed on the display panel 4. In the operation illustrated in FIG. 6A, an image data corresponding to a general image is supplied to the image processing circuitry 33 in the first vertical sync period. In one or more embodiments, the driving mode of the gate lines G is set to the first mode at the beginning of the following second vertical sync period.

In one or more embodiments, in the following second vertical sync period, the image data received by the image processing circuitry 33 during a period during which the value of the line counter ranges "2" to "5" does not satisfy the condition to switch the driving mode, as illustrated in FIG. 6B. The driving mode of the gate lines G is maintained in the first mode during a following period during which the value of the line counter ranges from "6" to "9."

The image data received by the image processing circuitry 33 during the period during which the value of the line counter ranges from "6" to "9" satisfies the condition to switch the driving mode to the second mode. The driving mode of the gate lines G is switched to the second mode during a following period during which the value of the line counter ranges from "10" to "13." In response to the driving mode being set to the second mode, the sorting circuitry 35 sorts the order of pixel data in the image data and supplies the sorted image data to the source driver 36. In one or more embodiments, the order of the pixel data of the image data are sorted so that the subpixels 6 driven with the drive voltage corresponding to the maximum grayscale value are successively driven, and the subpixels 6 driven with the drive voltage corresponding to the minimum grayscale value are successively driven.

The image data received by the image processing circuitry 33 satisfies the condition to set the driving mode to the second mode during the subsequent rest period of the second vertical sync period, and the driving mode is maintained in the second mode.

In the following third vertical sync period, as illustrated in FIG. 6C, the image data received by the image processing circuitry 33 still satisfies the condition to set the driving mode to the second mode during a period during which the value of the line counter ranges from "2" to "9." The driving mode is maintained in the second mode during a following period during which the value of the line counter ranges from "6" to "13."

In the third vertical sync period, the image data received by the image processing circuitry 33 during a period during which the value of the line counter ranges from "10" to "13" does not satisfy the condition to set the driving mode to the second mode. The driving mode is switched to the first mode during a following period during which the value of the line counter ranges from "14" to "17." The driving mode is maintained in the first mode during the subsequent rest period of the third vertical sync period.

The operation illustrated in FIGS. 6A to 6C also reduces the number of switching of the drive voltages applied to the source lines S between the level corresponding to the minimum grayscale value and the level corresponding to the maximum grayscale value, achieving reduction in the power consumption.

Figure 7A:
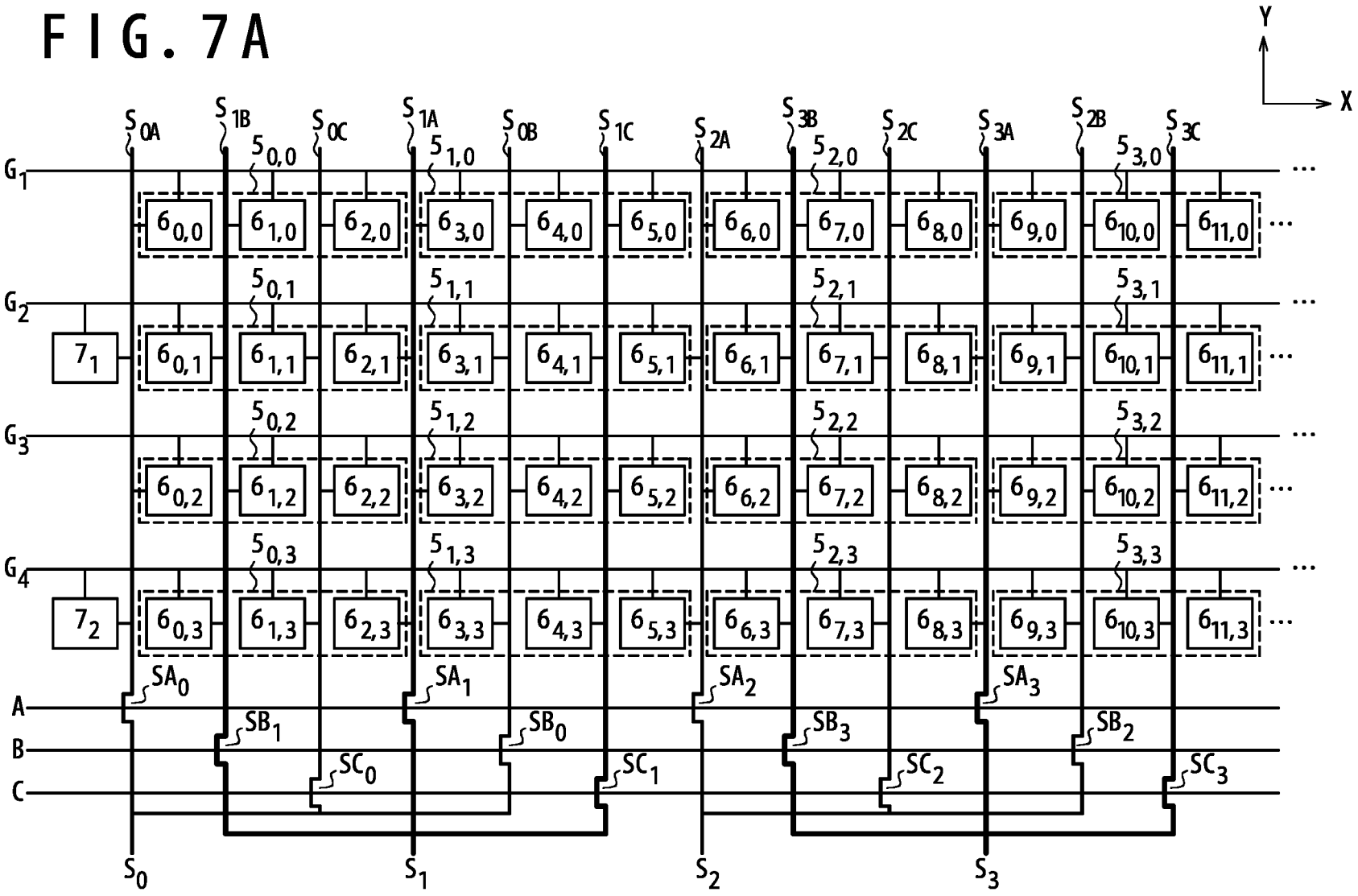
FIGS. 7A and 7B illustrate an example configuration of a display panel, according to one or more embodiments.
Figure 7B:
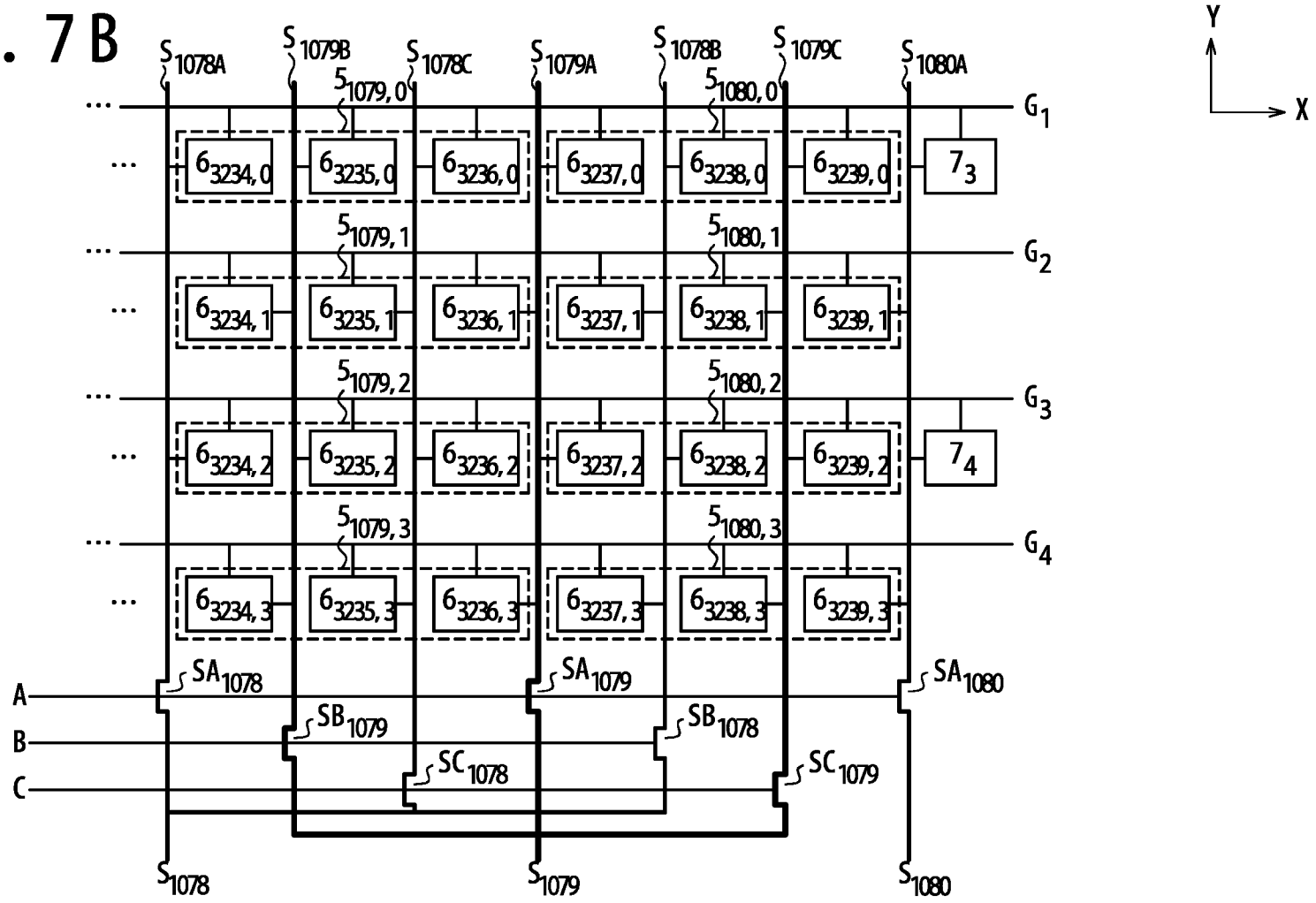

In other embodiments, as illustrated in FIGS. 7A and 7B, the display panel 4 comprises a zigzag panel adapted to time-divisional driving. In one or more embodiments, the display panel 4 comprises 1081 source lines sets $S_0$ to $S_{1080}$; FIG. 7A illustrates a portion corresponding to the source lines sets $S_0$ to $S_3$, and FIG. 7B illustrates a portion corresponding to the source lines sets $S_{1078}$ to $S_{1080}$. The display panel 4 may additionally comprise gate lines G, pixels 5, subpixels 6, dummy subpixels 7, selector lines A, B, C, selector switches SA, SB, and SC.

In one or more embodiments, each pixel $\mathbf{5}_{a,\,b}$ comprises a subpixel $\mathbf{6}_{3a,\,b}$ of the first color, a subpixels $\mathbf{6}_{3a+1,\,b}$ of the second color, and a subpixel $\mathbf{6}_{3a+2,\,b}$ of the third color. The subpixels $\mathbf{6}_{3a,\,b}$, $\mathbf{6}_{3a+1,\,b}$, and $\mathbf{6}_{3a+2,\,b}$ of the pixel $\mathbf{5}_{a,\,b}$ may be arrayed in the Y direction. In each pixel $\mathbf{5}_{a,\,b}$, the subpixel $\mathbf{6}_{3a+1,\,b}$ of the second color is adjacent to the subpixel $\mathbf{6}_{3a,\,b}$ of the first color in the +Y direction, and the subpixel $\mathbf{6}_{3a+2,\,b}$ of the third color is adjacent to the subpixel $\mathbf{6}_{3a+1,\,b}$ of the second color in the +Y direction. It should be noted however that the above-described arrangement is merely one example, not limiting this embodiment.

In one embodiment, each source line set $S_u$ comprises three source lines $S_{uA}$, $S_{uB}$, and $S_{uC}$. The source line set $S_{1080}$, however, comprises a single source line $S_{1080A}$. The three source lines $S_{uA}$, $S_{uB}$, and $S_{uC}$ of the source line set $S_u$ are connected to the display driver 3 via three selector switches $SA_u$, $SB_u$, and $SC_u$, respectively. As an exception, the source line $S_{1080A}$ of the source line set $S_{1080}$ is connected to the display driver 3 via the selector switch $SA_{1080}$. The three selector switches $SA_u$, $SB_u$, and $SC_u$ are connected to the selector lines A, B, and C, respectively.

All the selector switches $SA_u$ are set to the on state when the selector line A is in the on state, and the selector switches $SA_u$ are set to the off state when the selector line A is in the off state. Similarly, all the selector switches $SB_u$ are set to the on state when the selector line B is in the on state, and the selector switches $SB_u$ are set to the off state when the selector line B is in the off state. Further, all the selector switches $SC_u$ are set to the on state when the selector line C is in the on state, and the selector switches $SC_u$ are set to the off state when the selector line C is in the off state. At most one of the selectors lines A, B, and C may be allowed to be in the on state, moment to moment. The selector lines A, B, and C may be driven by the first panel interface circuitry 37A or the second panel interface circuitry 37B under control of the control circuitry 34. The three source lines $S_{uA}$, $S_{uB}$, and $S_{uC}$ of each source line set $S_u$ may be time-divisionally driven with the selector lines A, B, and C and the selector switches $SA_u$, $SB_u$, and $SC_u$.

The six source lines of adjacent source line sets $S_u$ and $S_{u+1}$ may be extended in the Y axis direction and arrayed in the X axis direction. The three source lines of the source line set $S_u$ and the three source lines of the source line set $S_{u+1}$ may be alternatingly arrayed in the X axis direction. With respect to these six source lines, a source line connected to a selector switch SA connected to the selector line A, a source line connected to a selector switch SB connected to the selector line B, a source line connected to a selector switch SC connected to the selector line C may be arrayed in the +X direction in this order. In the example illustrated in FIGS. 7A and 7B, the six source lines $S_{uA}$, $S_{u+1B}$, $S_{uC}$, $S_{u+1A}$, $S_{uB}$, and $S_{u+1C}$ of the source line sets $S_u$ and $S_{u+1}$ are arrayed in the +X direction in this order.

Each source line of each source line set $S_u$ may be connected to subpixels 6 positioned in the +X direction with respect to this source line and subpixels 6 positioned in the −X direction with respect to this source line, alternatingly. The source line $S_{uA}$ of an even-numbered source line set $S_u$ may be connected to the subpixels $\mathbf{6}_{6u,\,0}$, $\mathbf{6}_{6u-1,\,1}$, $\mathbf{6}_{6u,\,2}$, and $\mathbf{6}_{6u-1,\,3}$, the source line $S_{uB}$ of the same may be connected to the subpixels $\mathbf{6}_{6u+4,\,0}$, $\mathbf{6}_{6u+3,\,1}$, $\mathbf{6}_{6u+4,\,2}$, and $6_{6u+3,\,3}$, and the source line $S_{uC}$ of the same may be connected to the subpixels $\mathbf{6}_{6u+2,\,0}$, $\mathbf{6}_{6u+1,\,1}$, $\mathbf{6}_{6u+2,\,2}$, and $\mathbf{6}_{6u+1,\,3}$. As an exception, the source line $S_{0A}$ of the source line set $S_0$ may be connected to the subpixel $\mathbf{6}_{0,\,0}$, the dummy subpixel $\mathbf{7}_1$, and the subpixel $\mathbf{6}_{0,\,2}$ and the dummy subpixel $\mathbf{7}_2$. As another exception, the source line $S_{1080A}$ of the source line set $S_{1080}$ may be connected to the dummy subpixel $\mathbf{7}_3$, the subpixel $\mathbf{6}_{3239,\,1}$, the dummy subpixel $\mathbf{7}_4$, and the subpixels $\mathbf{6}_{3239,\,1}$. The source line $S_{uA}$ of an odd-numbered source line $S_u$ may be connected to the subpixels $\mathbf{6}_{6u-3,\,0}$, $\mathbf{6}_{6u-4,\,1}$, $\mathbf{6}_{6u-3,\,2}$, and $\mathbf{6}_{6u-4,\,3}$, the source line $S_{uB}$ of the same may be connected to the subpixels $\mathbf{6}_{6u-5,\,0}$, $\mathbf{6}_{6u-6,\,1}$, $\mathbf{6}_{6u-5,\,2}$, and $\mathbf{6}_{6u-6,\,3}$, and the source line $S_{uC}$ of the same may be connected to the subpixels $\mathbf{6}_{6u-1,\,0}$, $\mathbf{6}_{6u-2,\,1}$, $\mathbf{6}_{6u-1,\,2}$, and $\mathbf{6}_{6u-2,\,3}$.

Figure 8A:
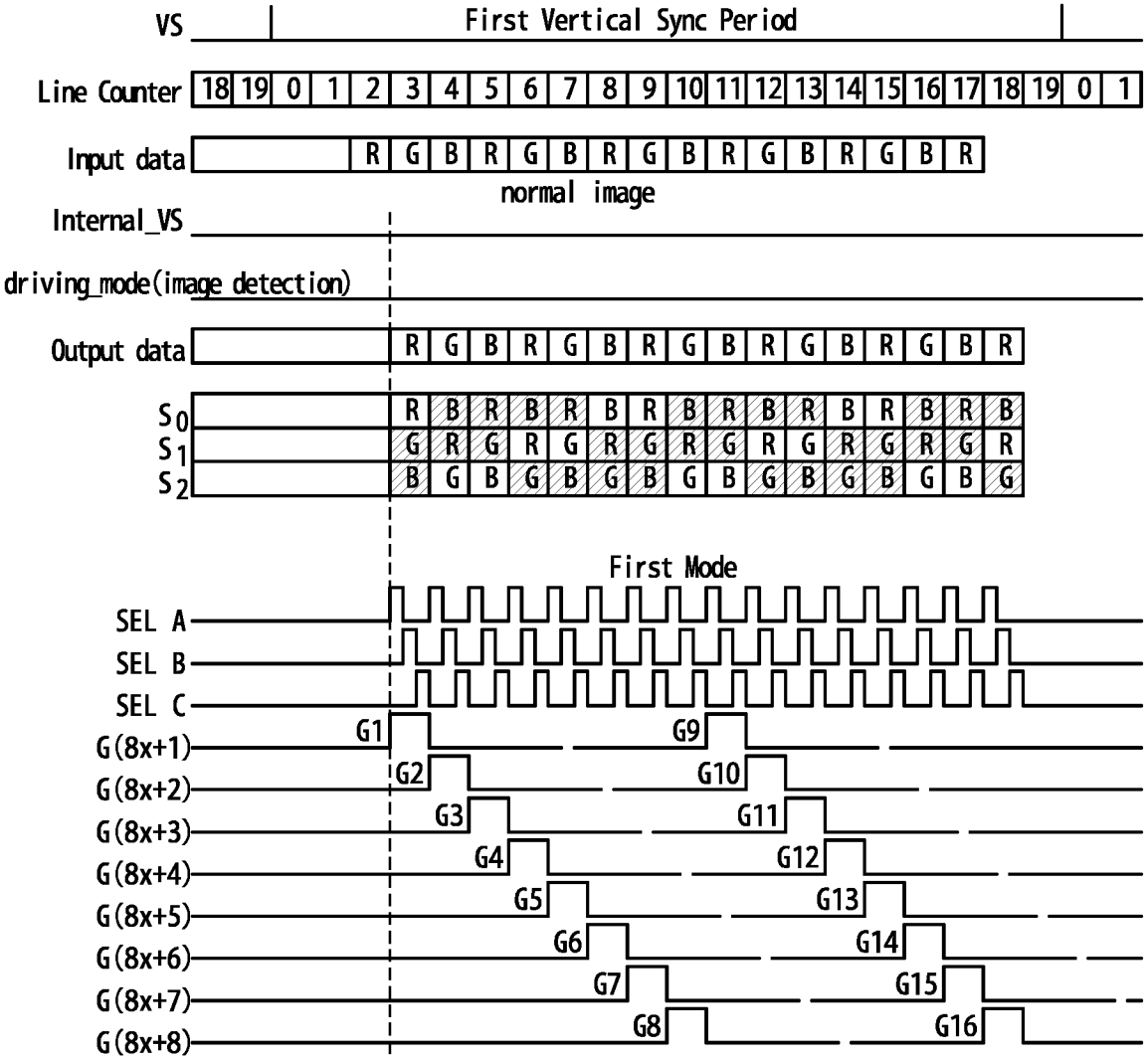
FIGS. 8A to 8C illustrate an example operation of a display device, according to one or more embodiments.
Figure 8B:
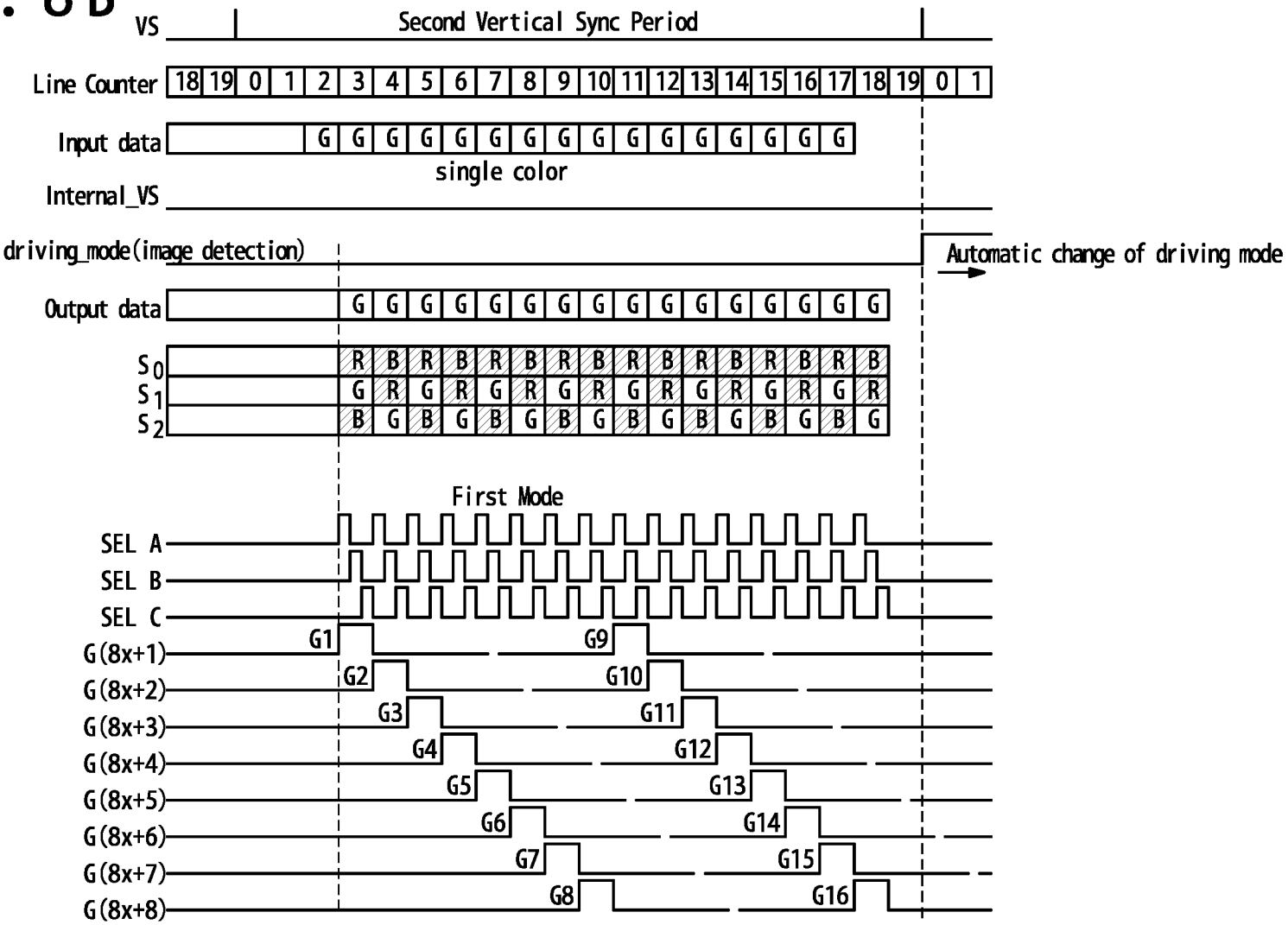
Figure 8C:
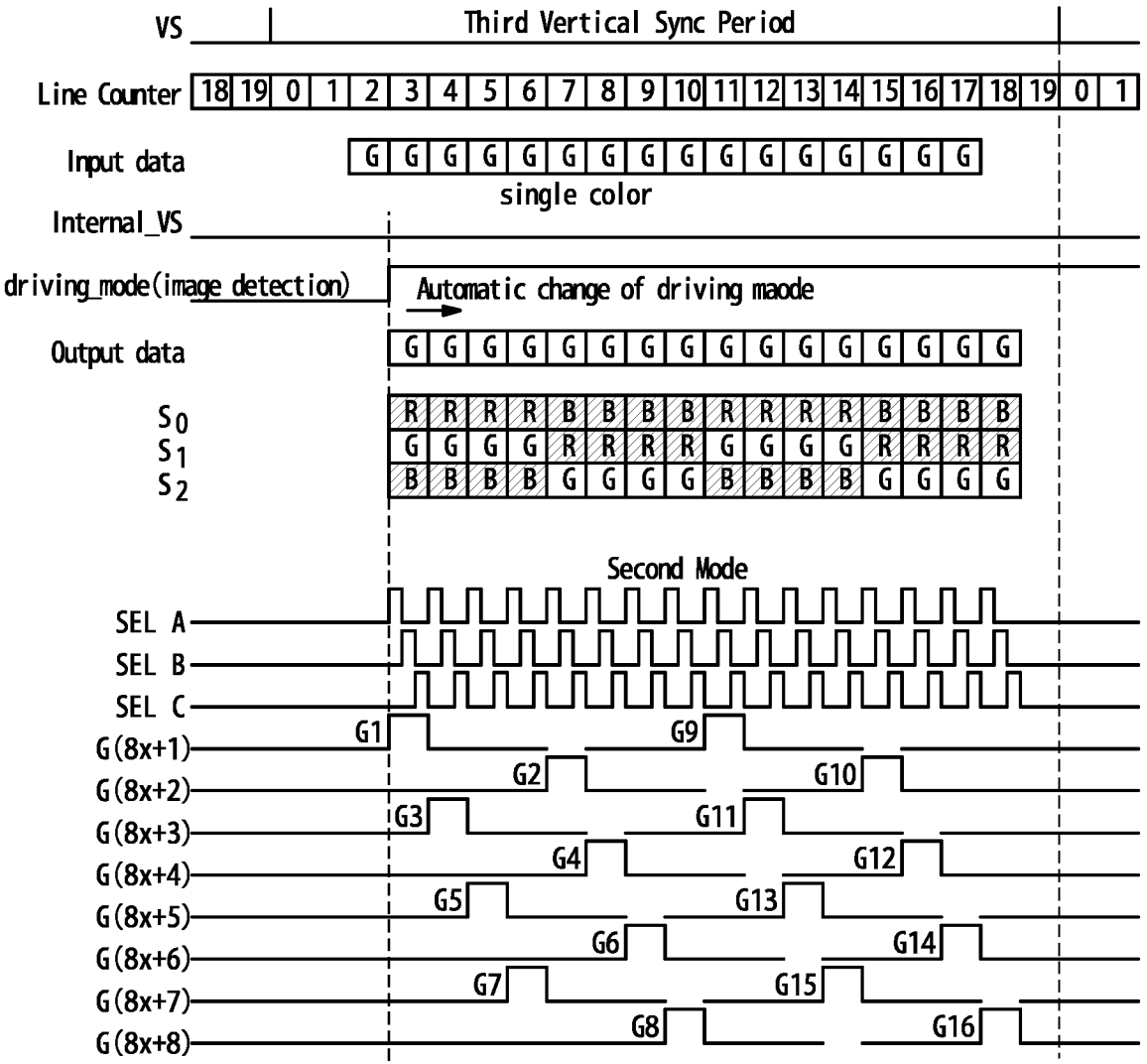

FIGS. 8A, 8B, and 8C are timing charts illustrating one example operation of the display device 1 that comprises the display panel 4 configured as illustrated in FIGS. 7A and 7B. In FIGS. 8A, 8B, and 8C, "$S_0$" to "$S_3$" indicate subpixel data corresponding to subpixels 6 connected to the source line sets $S_0$ to $S_3$. "SEL A", "SEL B", and "SEL C" indicate the on/off states of the selectors A, B, and C, respectively. In one or more embodiments, the operation illustrated in FIG. 8A is performed in a first vertical sync period, the operation illustrated in FIG. 8B is performed in a following second vertical sync period, and the operation illustrated in FIG. 8C is performed in a following third vertical sync period.

In the example operation illustrated in FIGS. 8A, 8B, and 8C, the display device 1 is configured to detect whether the image data received by the image processing circuitry 33 satisfies a predetermined condition. In one or more embodiments, the image data that satisfies the predetermined condition comprises an image data that specifies the same color for all the pixels 5 for one frame. The same color may be any one of the colors of the subpixels 6. The display device 1 may switch the driving mode of the gate lines G to the second mode when detecting the image data that satisfies the predetermined condition.

In one or more embodiments, as illustrated in FIG. 8A, the driving mode is set to the first mode in the first vertical sync period, and the plurality of gate lines G are driven in the order in which the gate lines G are arrayed on the display panel 4. In the operation illustrated in FIG. 8A, an image data corresponding to a general image is inputted to the image processing circuitry 33. In this operation, the source lines $S_{uA}$, $S_{uB}$, and $S_{uC}$ may be time-divisionally driven. In one or more embodiments, the driving mode of the gate lines G is set to the first mode also in the following second vertical sync period.

In the following second vertical sync period, as illustrated in FIG. 8B, the image data input to the sorting circuitry 35 specifies green (the second color) for all the pixels 5 of the image. In one or more embodiments, the image feature detection section 331 of the image processing circuitry 33 detects an image data that specifies the second color for all the pixels 5 in the second vertical sync period. Based on this detection, the control circuitry 34 sets the driving mode of the gate lines G to the second mode in the following third vertical sync period. As illustrated in FIG. 8C, in the third vertical sync period, the gate lines $G_1$, $G_3$, $G_5$, and $G_7$ are driven in this order, and then the gate lines $G_2$, $G_4$, $G_6$, and $G_8$ are driven in this order, in one or more embodiments. In this operation, the source lines $S_{uA}$, $S_{uB}$, and $S_{uC}$ may be time-divisionally driven.

In the third vertical sync period, as is the case with the second vertical sync period, the image data supplied to the sorting circuitry 35 specifies green (the second color) for all the pixels 5 of the image. In response to the driving mode being set to the second mode, the sorting circuitry 35 sorts the order of pixel data in the image data and supplies the sorted image data to the source driver 36. In one or more embodiments, similarly to the operation illustrated in FIG. 5C, the order of the pixel data of the image data are sorted so that the subpixels 6 driven with the drive voltage corresponding to the maximum grayscale value are successively driven, and the subpixels 6 driven with the drive voltage corresponding to the minimum grayscale value are successively driven. This operation reduces the number of switching of the voltages applied to the source lines S between the level corresponding to the minimum grayscale value and the level corresponding to the maximum grayscale value, achieving reduction in the power consumption.

Figure 9A:
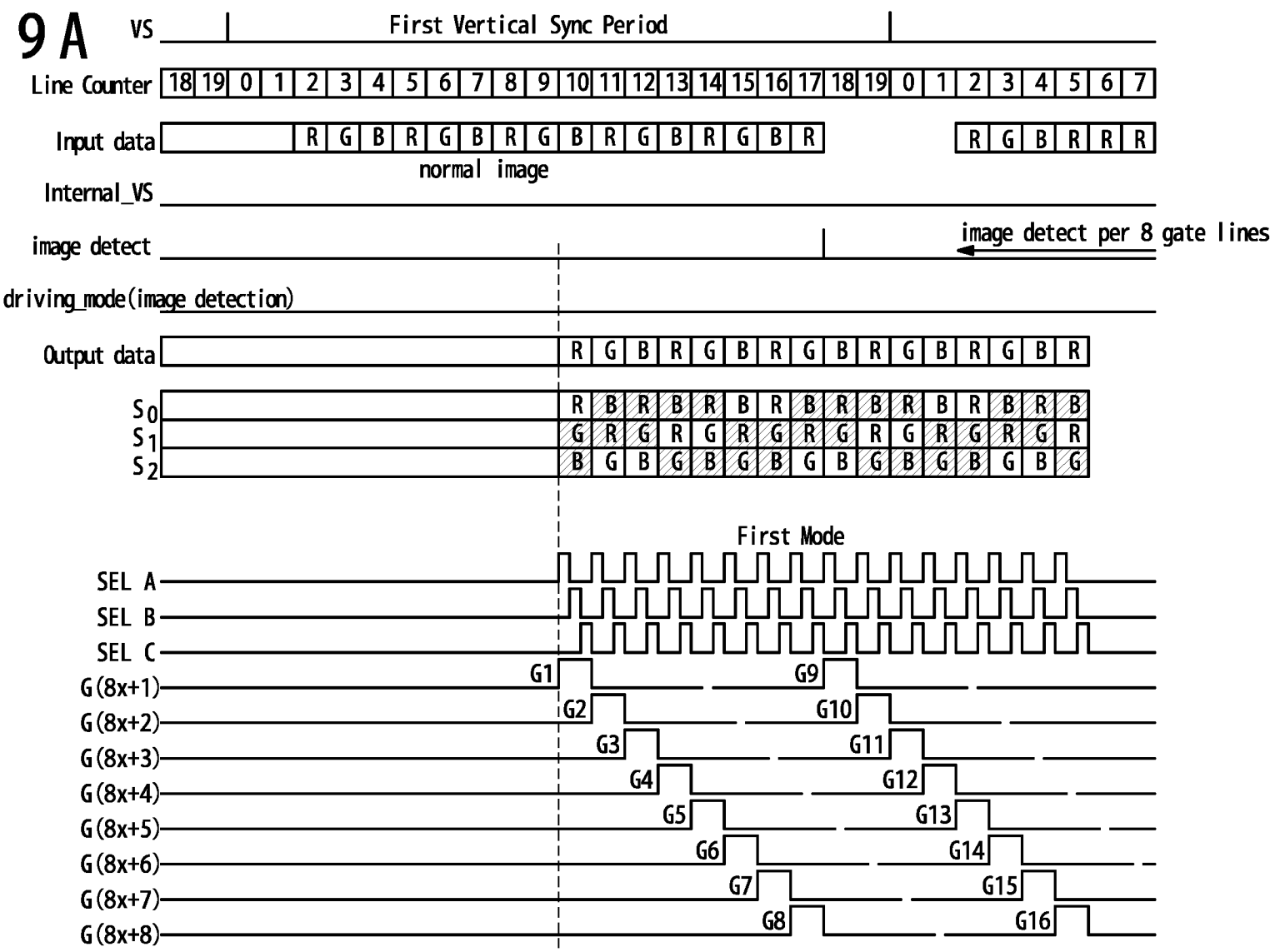
FIGS. 9A to 9C illustrate an example operation of a display device, according to one or more embodiments.
Figure 9B:
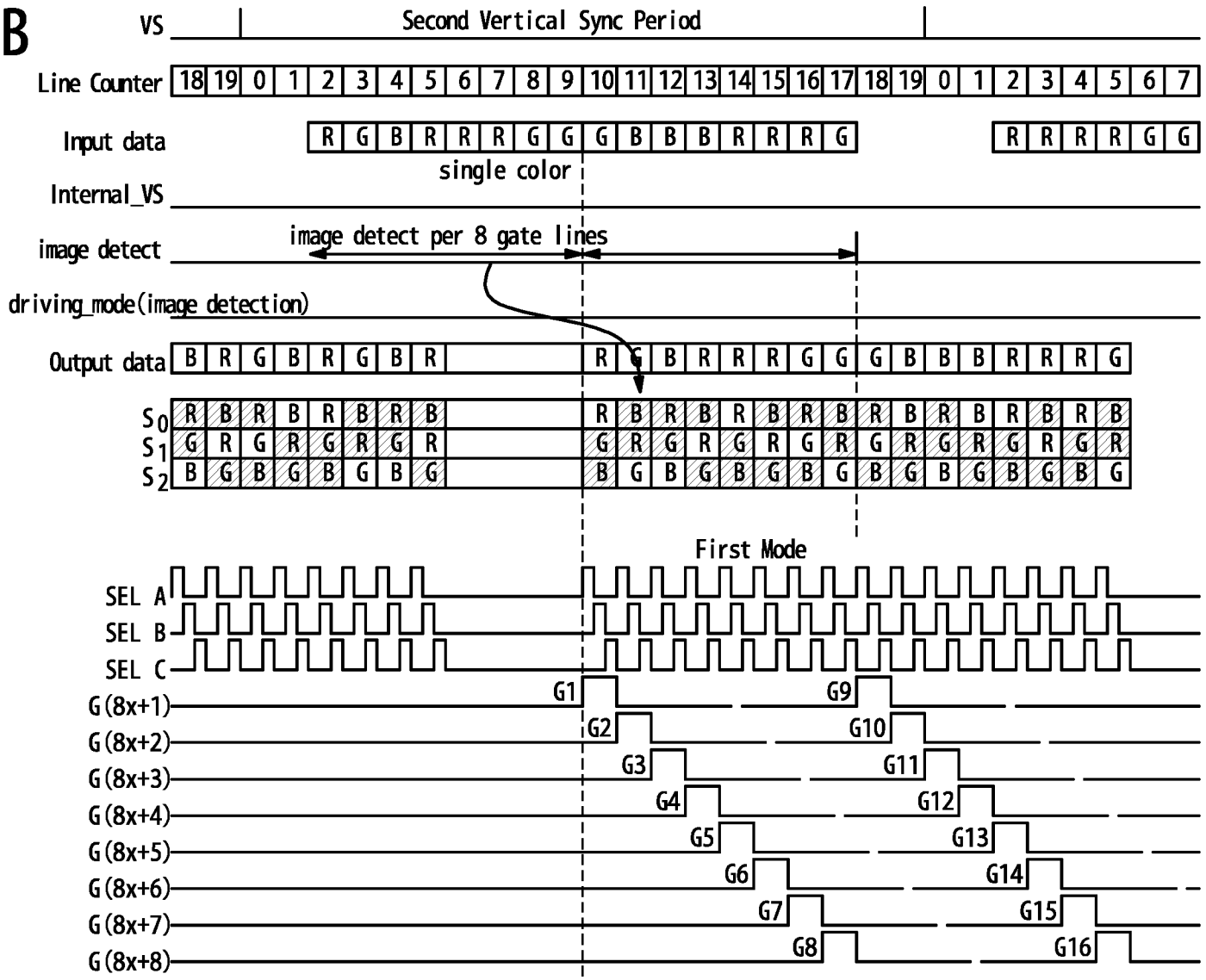
Figure 9C:
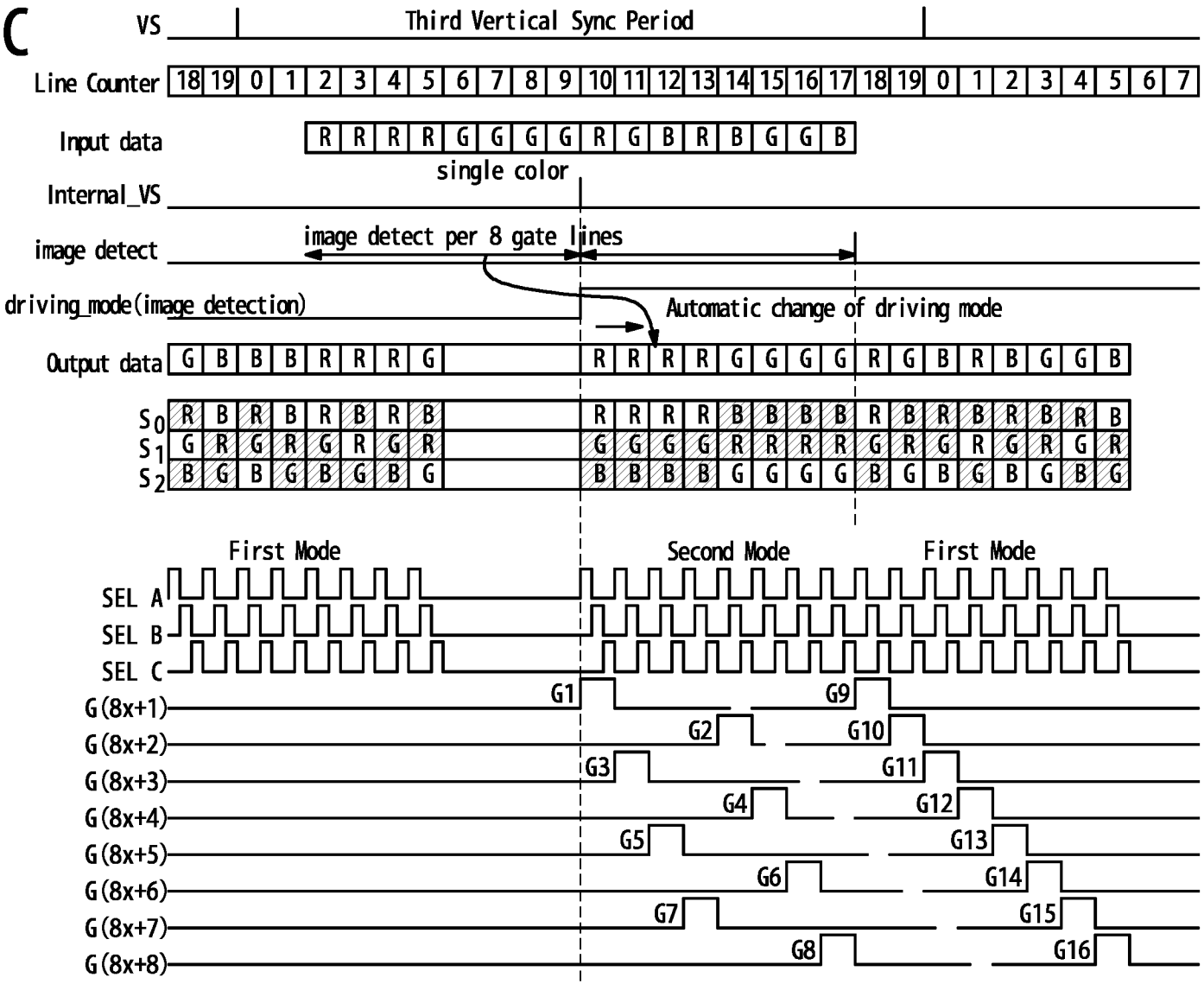

FIGS. 9A, 9B, and 9C are timing charts illustrating another example operation of the display device 1 that comprises the display panel 4 configured as illustrated in FIG. 7. In one or more embodiments, the operation illustrated in FIG. 9A is performed in a first vertical sync period, the operation illustrated in FIG. 9B is performed in a following second vertical sync period, and the operation illustrated in FIG. 9C is performed in a following third vertical sync period.

In the embodiment illustrated in FIGS. 9A, 9B, and 9C, the driving mode of the gate lines G is switched to the second mode when an image data that specifies the same color for pixels 5 of a predetermined number of successive horizontal lines is detected. The same color may be any one of the colors of the subpixels 6. For example, the driving mode of the gate lines G may be switched to the second mode when an image data that specifies the same color for pixels 5 of four successive horizontal lines is detected.

In one or more embodiments, as illustrated in FIG. 9A, the driving mode is set to the first mode in the first vertical sync period, and the plurality of gate lines G are driven in the order in which the gate lines G are arrayed on the display panel 4. In this operation, the source lines $S_{uA}$, $S_B$, and $S_{uC}$ may be time-divisionally driven. In the operation illustrated in FIG. 9A, an image data corresponding to a general image is supplied to the image processing circuitry 33 in the first vertical sync period. In one or more embodiments, the driving mode of the gate lines G is set to the first mode at the beginning of the following second vertical sync period.

In one or more embodiments, as illustrated in FIG. 9B, an image data corresponding to a general image is supplied to the image processing circuitry 33 also in the following second vertical sync period, and the driving mode of the gate lines G is maintained in the first mode. In one or more embodiments, the driving mode of the gate lines G is still set to the first mode at the beginning of the following third vertical sync period.

In the following third vertical sync period, as illustrated in FIG. 9C, the image data received by the image processing circuitry 33 during a period during which the value of the line counter ranges from "2" to "9" satisfies the condition to switch the driving mode, in one or more embodiments. The driving mode of the gate lines G is switched to the second mode during a following period during which the value of the line counter ranges from "10" to "17." In response to the driving mode being set to the second mode, the sorting circuitry 35 sorts the order of pixel data in the image data and supplies the sorted image data to the source driver 36. In one or more embodiments, the order of the pixel data of the image data are sorted so that the subpixels 6 driven with the drive voltage corresponding to the maximum grayscale value are successively driven, and the subpixels 6 driven with the drive voltage corresponding to the minimum grayscale value are successively driven. Such operation reduces the number of switching of the voltages applied to the source lines S between the level corresponding to the minimum grayscale value and the level corresponding to the maximum grayscale value, achieving reduction in the power consumption. In this operation, the source lines $S_{uA}$, $S_{uB}$, and $S_{uC}$ may be time-divisionally driven.

The image data received by the image processing circuitry 33 during a period during which the value of the line counter ranges from "10" to "17" does not satisfy the condition to switch the driving mode. The driving mode is switched to the first mode during the subsequent rest period of the third vertical sync period.

As thus described, also in the case where the display panel 4 is configured as illustrated in FIGS. 7A and 7B, the power consumption can be reduced through an operation similar to that illustrated in FIGS. 6A, 6B, and 6C.

While various embodiments of this disclosure have been specifically described, the technologies disclosed herein may be implemented with various modifications. The features described in the above-described embodiments may be arbitrarily combined as long as there is no technological inconsistency.

What is claimed is:

1. A display device, comprising:

a display panel comprising:

a plurality of gate lines; and a plurality of pixels; and a display driver configured to:

control, based on a determination that first image data specifies a common color for at least two pixels of the plurality of pixels, an order in which the plurality of gate lines are driven; and sort the first image data based on the determination that the first image data specifies the common color for the at least two pixels of the plurality of pixels.

2. The display device of claim 1, wherein the display panel further comprises:

a source line;

a first subpixel of a first color connected to the source line and a first gate line of the plurality of gate lines; and a second subpixel of a second color connected to the source line and a second gate line of the plurality of gate lines, the second color being different from the first color.

3. The display device of claim 2, wherein the display panel further comprises:

a third subpixel of the first color connected to the source line and a third gate line of the plurality of gate lines; and a fourth subpixel of the second color connected to the source line and a fourth gate line of the plurality of gate lines, wherein the first and third subpixels of the first color and the second and fourth subpixels of the second color are alternatingly arrayed along the source line.

4. The display device of claim 3, wherein the display driver comprises:

a first mode to drive the first, second, third, and fourth subpixels in this order, and a second mode to drive the second and fourth subpixels after driving the first and third subpixels.

5. The display device of claim 4, wherein the display driver is configured to switch, based on the first image data, a driving mode to drive the plurality of gate lines between the first mode and the second mode.

6. The display device of claim 5, wherein the display driver is configured to switch the driving mode to the second mode based on a detection of a second image data specifying a same color for all pixels of the display panel in the first image data.

7. The display device of claim 6, wherein the same color is the first color or the second color.

8. The display device of claim 5, wherein the display driver is configured to switch the driving mode to the second mode based on a detection of a third image data specifying a same color for two or more of the pixels of a predetermined number or more of successive horizontal lines.

9. The display device of claim 8, wherein the same color is the first color or the second color.

10. The display device of claim 5, wherein the display driver further comprises:

image data sorting circuitry configured to sort, based on the driving mode, a fourth image data based on the first image data to generate a sorted image data; and a source driver configured to drive the source line based on the sorted image data.

11. A display driver, comprising:

image processing circuitry configured to receive a first image data;

control circuitry configured to generate a gate control signal to control, based on a determination that the first image data specifies a common color for at least two pixels of a display panel, an order in which a plurality of gate lines of display panel are driven; and image data sortinq circuitry configured to sort the first image data based on the determination that the first image data specifies the common color for the at least two pixels.

12. The display driver of claim 11, wherein the display panel further comprises:

a source line;

a first subpixel of a first color connected to the source line and a first gate line of the plurality of gate lines; and a second subpixel of a second color connected to the source line and a second gate line of the plurality of gate lines, the second color being different from the first color.

13. The display driver of claim 12, wherein the display panel further comprises:

a third subpixel of the first color connected to the source line and a third gate line of the plurality of gate lines; and a fourth subpixel of the second color connected to the source line and a fourth gate line of the plurality of gate lines, wherein the first and third subpixels of the first color and the second and fourth subpixels of the second color are alternatingly arrayed along the source line.

14. The display driver of claim 13, wherein the display driver comprises:

a first mode to drive the first, second, third, and fourth subpixels in this order, and a second mode to drive the second and fourth subpixels after driving the first and third subpixels.

15. The display driver of claim 14, wherein the display driver is configured to switch, based on the first image data, a driving mode to drive the plurality of gate lines between the first mode and the second mode.

16. The display driver of claim 15, wherein the display driver is configured to switch the driving mode to the second mode based on a detection of a second image data specifying a same color for all pixels of the display panel in the first image data.

17. The display driver of claim 15, wherein the display driver is configured to switch the driving mode to the second mode based on a detection of a third image data specifying a same color for pixels of a predetermined number or more of successive horizontal lines.

18. The display driver of claim 15, wherein the image data sorting circuitry is further configured to sort, based on the driving mode, a fourth image data based on the first image data to generate a sorted image data; and wherein the display driver further comprises a source driver configured to drive the source line based on the sorted image data.

19. A method, comprising:

receiving a first image data;

controlling based on a determination that the first image data specifies a common color for at least two pixels of a display panel, an order in which a plurality of gate lines of the display panel are driven; and sortinq the first image data based on the determination that the first image data specifies the common color for the at least two pixels.

20. The method of claim 19, wherein the display panel further comprises:

a source line;

a first subpixel of a first color connected to the source line and a first gate line of the plurality of gate lines; and a second subpixel of a second color connected to the source line and a second gate line of the plurality of gate lines, the second color being different from the first color.

* * * * *